US008408171B2

(12) United States Patent
Tanaka et al.

(10) Patent No.: US 8,408,171 B2
(45) Date of Patent: Apr. 2, 2013

(54) VARIABLE STROKE ENGINE ASSEMBLY

(75) Inventors: Shigekazu Tanaka, Wako (JP); Akinori Maezuru, Wako (JP); Taichi Yoshikawa, Wako (JP); Keitaro Nakanishi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 800 days.

(21) Appl. No.: 12/440,125

(22) PCT Filed: Sep. 7, 2007

(86) PCT No.: PCT/JP2007/000971

§ 371 (c)(1),
(2), (4) Date: Mar. 5, 2009

(87) PCT Pub. No.: WO2008/032438

PCT Pub. Date: Mar. 20, 2008

(65) Prior Publication Data

US 2010/0018504 A1 Jan. 28, 2010

(30) Foreign Application Priority Data

Sep. 12, 2006 (JP) ..... 2006-246957
Sep. 25, 2006 (JP) ..... 2006-258218
Oct. 2, 2006 (JP) ..... 2006-270545

(51) Int. Cl.
*F02D 15/04* (2006.01)

(52) U.S. Cl. ..... 123/48 R; 123/488; 123/48 B; 123/48 A

(58) Field of Classification Search ..... 123/48 B, 123/48 R, 78 B, 78 R, 179.1; 48/78
See application file for complete search history.

(56) References Cited

U.S. PATENT DOCUMENTS 4,270,495 A * 6/1981 Freudenstein et al. ..... 123/53.1
4,331,212 A * 5/1982 Tsuboi ..... 180/230
4,589,380 A * 5/1986 Coad ..... 123/46 R
5,038,731 A * 8/1991 Shimada ..... 123/192.2
5,046,578 A * 9/1991 Nakayama et al. ..... 180/291

(Continued)

FOREIGN PATENT DOCUMENTS

JP 2002-129995 5/2002
JP 2003-3906 1/2003

(Continued)

OTHER PUBLICATIONS

Machine Translation of JP2003003906A, as referenced by applicant in pior art. See attached document "JP2003003906A_translation.pdf".*

(Continued)

*Primary Examiner* — Noah Kamen
*Assistant Examiner* — Long T Tran
(74) *Attorney, Agent, or Firm* — Nelson Mullins Riley & Scarborough LLP; Anthony A. Laurentano

(57) ABSTRACT

In a variable stroke engine assembly for a front engine, front wheel drive vehicle, an engine output shaft (OS), a variable stroke control mechanism (63, 65, CR), an actuator (AC) and a starter motor (SM) are laid out in a favorable manner so that the general outer profile of the engine assembly can be made free from excessive protrusions, an increase in the engine room space requirement is avoided, layout freedom can be enhanced, and the cooling performance for the actuator can be improved.

14 Claims, 28 Drawing Sheets

U.S. PATENT DOCUMENTS

| | | | | |
|---|---|---|---|---|
| 6,343,579 | B1 * | 2/2002 | Yasuyama et al. | 123/90.16 |
| 6,443,263 | B1 * | 9/2002 | Ito et al. | 184/6.5 |
| 6,523,627 | B2 * | 2/2003 | Fukuda | 180/68.4 |
| 6,604,495 | B2 * | 8/2003 | Moteki | 123/48 B |
| 6,684,828 | B2 * | 2/2004 | Ushijima et al. | 123/48 B |
| 2004/0149243 | A1 * | 8/2004 | Yamada et al. | 123/78 F |
| 2006/0102116 | A1 * | 5/2006 | Maezuru et al. | 123/78 E |
| 2006/0144354 | A1 * | 7/2006 | Tanaka et al. | 123/48 B |
| 2007/0234990 | A1 * | 10/2007 | Shiino et al. | 123/179.16 |

FOREIGN PATENT DOCUMENTS

| | | |
|---|---|---|
| JP | 2003-322036 | 11/2003 |
| JP | 2005-8114 | 1/2005 |
| JP | 2005-256777 | 9/2005 |
| JP | 2005-256818 | 9/2005 |
| JP | 2006-177192 | 7/2006 |

OTHER PUBLICATIONS

International Preliminary Report on Patentability for Application No. PCT/JP2007/000971, dated Mar. 17, 2009.

* cited by examiner

VARIABLE STROKE ENGINE ASSEMBLY

RELATED APPLICATIONS

This application is a 35 U.S.C. 371 national stage filing of International Application No. PCT/JP2007/000971, filed on Sep. 7, 2007, which claims priority to Japanese Patent Application No. 2006-246957 filed on Sep. 12, 2006, Japanese Patent Application No. 2006-258218 filed on Sep. 25, 2006, and Japanese Patent Application No. 2006-270545 filed on Oct. 2, 2006 in Japan. The contents of the aforementioned applications are hereby incorporated by reference.

TECHNICAL FIELD

The present invention relates to a variable stroke engine assembly, and in particular to a technology for improving the freedom in the link layout and the suitability of the engine to be mounted in an engine room of a motor vehicle.

BACKGROUND OF THE INVENTION

In a known variable stroke engine, a piston is connected to a crankshaft via a plurality of links, and one of the links is connected to an eccentric portion provided on a control shaft supported by an engine main body via a control link so that the position of the end of the control link supported by the engine main body may be changed by turning the control shaft and the piston stroke may be thereby changed in a continuous manner. See Japanese patent laid open publication No. 2006-177192 and Japanese Patent Laid Open Publication No. 2003-322036.

In such a variable stroke engine, because the link mechanism required for varying the stroke of the piston is highly complex and an actuator is required for driving the control shaft, the size of the engine, in particular the lateral width of the engine as seen from the crankshaft end tends to be larger than those of comparable conventional engines. Therefore, because of the need to mount the engine in the engine room so as to avoid an interference with the output shaft for transmitting the engine output to the wheels, the engine room is required to be larger than desired to accommodate the engine. In particular in case of a FF (front engine, front wheel drive) car in which the engine is disposed in the engine room with the crankshaft oriented in a lateral direction, because of the need to avoid the interference with the half shaft for driving the front wheels, it is difficult to reduce the size of the engine room.

A starter motor is typically mounted on one side of the engine main body, and this starter motor drives a flywheel (ring gear) when starting the engine. In a variable stroke engine, it is important to determine the positioning of a starter motor so as not to interfere with various link members that form a variable stroke link mechanism.

In such a variable stroke engine, because of the presence of the control shaft and control link, one of the side walls of the engine main body (typically consisting of a cylinder block) substantially bulges out as seen from the axial direction of the crankshaft. Therefore, when a starter motor is installed without any layout consideration, the freedom in the design of the link geometry (layout of the control shaft and control link) may be impaired, and the engine may fail to be properly mounted in the engine room of the motor vehicle.

When the actuator of such a variable stroke engine is heated to a high temperature owing to the heat of the exhaust manifold or the like, various problems may be created. It is proposed in Japanese patent laid open publication No. 2006-177192 to control the rise in the temperature of the actuator by placing the actuator on the exterior of the engine so that the flow of air from the front part of the vehicle owing to the motion of the vehicle may be effectively directed to the actuator and as far away from the exhaust manifold as possible. However, the arrangement disclosed in Patent Japanese patent laid open publication No. 2006-177192 is not able to adequately prevent the rise in the temperature of the actuator, and there is a need to more effectively protect the actuator from heat. Also, the freedom in the layout of the actuator was limited.

BRIEF SUMMARY OF THE INVENTION

In view of such problems of the prior art, a primary object of the present invention is to provide a variable stroke engine that allows the space efficiency to be improved and the space requirement of the engine room to be minimized.

A second object of the present invention is to provide a variable stroke engine that allows a high degree of freedom in the link layout and enables the engine to be mounted in the engine room of a motor vehicle in a favorable manner.

A third object of the present invention is to provide an improved heat shielding effect for the actuator of a variable stroke engine.

According to the present invention, such objects can be at least partially achieved by providing a variable stroke engine assembly for a front engine, front wheel drive vehicle, comprising: a piston slidably received in a cylinder; a crankshaft rotatably support by an engine main body; an output shaft extending along a rear side of the engine main body substantially in parallel with the crankshaft to transmit an engine output to front wheels of a vehicle carrying the engine assembly; a connecting mechanism functionally connecting the piston with the crankshaft; a control shaft rotatably supported by the engine main body and coupled to the connecting mechanism for varying a configuration of the connecting mechanism; and an actuator coupled to the control shaft for driving the control shaft; wherein at least one of the control shaft and the actuator is disposed on a different side of the output shaft with respect to the crankshaft as seen in plan view.

Thereby, the space between the output shaft for driving the front wheels and the crankshaft is not required to be made greater than that of a conventional engine so that the size of the engine assembly is not required to be increased and the front overhang is not required to be increased. Additionally, the freedom in the layout of the actuator can be increased. Therefore, the space efficiency can be improved and the space requirement of the engine room can be minimized. Typically, the control shaft is disposed substantially in parallel with the crankshaft.

According to a preferred embodiment of the present invention, both the actuator and control shaft are disposed on the different side of the output shaft with respect to the crankshaft, and the actuator provides a greater road clearance that an engine component that defines a minimum road clearance. Because the minimum road clearance is not affected, the size of the engine room is not required to be increased, and the actuator can be protected from damages. Furthermore, the actuator may be mounted on a relatively rigid part of the engine such as the connecting portion between the cylinder block and oil pan and the connecting portion between the engine main body and transmission system.

The engine is often tilted rearward. In such a case, the actuator may be located in front of the engine at a substantially same elevation as the output shaft so that the mounting space for the actuator can be readily made available, and not only the freedom of layout can be increased but also the cooling efficiency of the actuator can be improved.

According to a preferred embodiment of the present invention, the connecting mechanism comprises a lower link pivotally supported by a crankpin of the crankshaft, an upper link connecting one end of the lower link to a piston pin of the piston, and a control link connected to another end of the lower link and an eccentric portion of the control link so that a piston stroke may be varied by turning the control shaft. In such a layout, it is highly important how to determine where on the engine main body a starter motor should be mounted so as to minimize the outer profile of the engine assembly.

According to a certain aspect of the present invention, a starter motor is mounted on the engine main body on an opposite side of a connecting point between the lower link and the control link with respect to a reference line passing through an axial center of the crankshaft and extending in parallel with a cylinder axial line. Thereby, the starter motor does not impose any restriction on the layout of the connecting point between the lower link and control link, and it is possible to obtain an optimum link layout.

According to yet another aspect of the present invention, a starter motor is mounted on the engine main body on an opposite side of an axial center of the control shaft with respect to a reference line passing through an axial center of the crankshaft and extending in parallel with a cylinder axial line. Thereby, the starter motor does not impose any restriction on the layout of the control shaft, and it is possible to obtain an optimum link layout.

According to yet another aspect of the present invention, the control shaft is located at a higher elevation than a connecting point between the lower link and the control link; and a starter motor is mounted on a part of the engine main body at a lower elevation than the connecting point between the lower link and the control link. In this case, because the side of the engine main body which does not have the control link and control shaft does not have the starter motor either, the space on this side of the engine main body can be advantageously utilized, and this increases the freedom in the layout of the engine in an engine room.

According to yet another aspect of the present invention, the engine consists of an in-line multiple cylinder engine; a transmission system is connected to an axial end of the engine main body; a connecting point between the lower link and the control link for a cylinder adjacent to the transmission system is located at a lower elevation than a connecting point between the lower link and the control link for another cylinder; the control shaft is located at a higher elevation than the connecting point between the lower link and the control link; and a starter motor is mounted on the axial end of the engine main body adjacent to the transmission system at a higher elevation than the connecting point between the lower link and the control link for the cylinder adjacent to the transmission system. Thereby, not only a space for mounting a starter motor is secured but also the reduction in the vibrations can be achieved by varying the connecting point between the lower link and control link from one cylinder to another.

According to yet another aspect of the present invention, the control shaft is located at a lower elevation than a connecting point between the lower link and the control link; and a starter motor is mounted on the engine main body at a higher elevation than the connecting point between the lower link and the control link. In this case, because the side of the engine main body which does not have the control link and control shaft does not have the starter motor either, the space on this side of the engine main body can be advantageously utilized, and this increases the freedom in the layout of the engine in an engine room.

According to yet another aspect of the present invention, the control shaft is located at a lower elevation than a connecting point between the lower link and the control link; a starter motor is mounted on the engine main body at a higher elevation than the connecting point between the lower link and the control link; and the distance from the connecting point between the lower link and control link to an axial center of the crankshaft is always smaller than the distance from an axial center of the control shaft to an axial center of the crankshaft. Thereby, the utilization of mounting space and the freedom in the layout of the engine in an engine room can be enhanced even further.

DETAILED DESCRIPTION OF THE PREFERRED EMBODIMENTS

Now the present invention is described in the following in more detail in terms of concrete embodiments with reference to the appended drawings. In various embodiments of the present invention, like parts are denoted with like numerals without repeating description of such parts. Also, as can be readily appreciated by a person skilled in the art, various variations of one embodiment are applicable to any other embodiments although the description may not cover every such possibility.

FIG. 1 is a front view of a variable compression ratio engine given as a first embodiment of the present invention. The engine E comprises crankshaft 30 having journals 30J rotatably supported by bearings formed in an interface between a cylinder block and a crankcase and a plurality of cylinders 4 arranged along the axial direction of the crankshaft 30, and is similar to a conventional in-line multi-cylinder engine in this regard. A piston 11 slidably received in each cylinder 5 is connected to a crankpin 30P which is radially offset from the journals 30J via an upper link 61 and a lower link 60.

The lower link 60 is substantially triangular in shape, and an intermediate point thereof is pivotally connected to the crankpin 30P. An end of the lower link 60 is connected to the piston 11 via the upper link 61.

A journal 65J of the control shaft 65 is rotatably supported by a bearing provided, for instance, in the crankcase 4 at a point forwardly and downwardly of the crankshaft 30.

The control shaft 65 is provided with an eccentric portion 65P in a similar way as the crankshaft 30 is provided with the crankpin 30P, and the eccentric portion 65P is connected to the other end of the lower link 60 via a control link 63 similar to a connecting rod connecting a piston to a crankshaft in a conventional engine.

The control shaft 65 can be turned over a prescribed range (about 90 degrees) with an hydraulically actuator AC connected to an end thereof.

The actuator AC is provided with a pair of vanes 87 extending radially outwardly from a drive shaft 66 on a diametric line passing through a rotational center of the drive shaft 66 and a pair of oil chambers 86 each receiving the corresponding vane 87 as illustrated in FIG. 2. The rotational direction of the actuator AC can be changed by switching the flow of oil placed under pressure by a pump P to a selected side of the vane 87 in the oil chamber 86 by using a solenoid valve V, and the vanes 87 (control shaft 66) can be kept at a desired angular position by retaining the oil pressure in the oil chamber 86.

An intake system 34 is connected to the front side of a cylinder head 3 of the engine E, and an exhaust system 35 is connected to the rear side of the cylinder head 3 of the engine E.

The mode of operation of the device of the present invention is described in the following. Depending on the loading condition of the engine E, the actuator AC is operated so as to vertically move the eccentric portion 65P by turning the control shaft 65 connected to the actuator AC. When the eccentric portion 65P is placed at a lower position, the control link 63 is pulled downward so that the lower link 60 tilts around the crankpin 30P of the crankshaft 30 in clockwise direction, and the upper link 61 is pushed upward. As a result, the top dead center of the piston 11 is raised upward.

Conversely, when the eccentric portion 65P of the control shaft 65 is placed at a higher position, the control link 63 is pushed upward so that the lower link 60 tilts around the crankpin 30P of the crankshaft 30 in counter clockwise direction, and the upper link 61 is pulled downward. As a result, the top dead center of the piston 11 is lowered downward.

By thus vertically moving the connecting point between the control link 63 and engine main body by turning the control shaft 65, the constraint on the movement of the lower link 60 is changed, and the stroke property of the piston 11 including the position of the top dead center position can be continuously changed. Therefore, the compression ratio or displacement of the engine can be freely controlled. The variable piston stroke mechanism is per se known. See Japanese patent laid open publication No. 2006-177192 if necessary.

In this engine E, the control shaft 65 and the actuator AC that angularly drives the control shaft 65 are positioned on an opposite side of a drive shaft OS for the front wheels serving as an output shaft for transmitting the engine output to the wheels with respect to the crankshaft 30.

The actuator AC is attached to a relatively rigid part such as a lower block of the engine to which a transmission system is connected, and at a position higher than a member that determines the minimum road clearance of the engine (such as an oil pan 10). Thereby, an adequate mounting rigidity for the actuator AC can be ensured without affecting the minimum road clearance.

According to this arrangement, the space between the drive shaft OS for driving the front wheels and the crankshaft 30 is not required to be made greater than that of a conventional engine so that the size of the transmission system is not required to be increased and the front overhang is not required to be increased. Because the actuator AC is placed on the front side of the engine E while the drive shaft OS is disposed to the rear of the engine E, the actuator AC can be favorably cooled by the wind caused by the movement of the vehicle.

The foregoing embodiment is also applicable to a longitudinally disposed engine for a four-wheel drive vehicle having an output shaft (drive shaft) for transmitting drive force from a transfer system to the front wheels that extends along one side of the engine. The foregoing embodiment was directed to in-line four-cylinder engines, but the present invention is equally applicable to V-type engines as well.

FIG. 3 is a simplified front view showing the structure of a variable compression ratio engine given as a second embodiment of the present invention. In FIG. 3, the cylinder head and other parts located above the cylinder head are omitted from illustration. The valve actuating mechanism, intake system and exhaust system of this engine may not be different from those of conventional four-stroke engines.

Referring to FIG. 3, a piston 11 that is slidably received in a cylinder 5 of the engine E is connected to a crankshaft 30 via an upper link 61 and a lower link 60. The crankshaft 30 is essentially no different from that of a conventional fixed compression ratio engine, and comprises a crank journal 30J (rotational center of the crankshaft) supported by a crankcase (engine main body) 4 and a crankpin 30P radially offset from the crank journal 30J. An intermediate point of the lower link 60 is supported by the crankpin 30P so as to be able to tilt like a seesaw. An end 60*a* of the lower link 60 is connected to a big end 61*b* of the upper link 61, and a small end 61*a* of the upper link 61 is connected to a piston pin 13. A counterweight is provided in association with the crankshaft 30 so as to cancel a primary rotary oscillation component of the piston movement, but is not shown in the drawing as it is not different from that of a conventional reciprocating engine.

The other end 60*b* of the lower link 60 is connected to a small end 63*a* of a control link 63 which is similar in structure to a connecting rod that connects a piston with a crankshaft in a normal engine. A big end 63*b* of the control link 63 is connected to an eccentric portion 65P of an control shaft 65, which is rotatably supported by the crankcase 4 and extends in parallel with the crankshaft 30, via a bearing bore formed by using a bearing cap 63*c*. In the illustrated embodiment, the control link 63 and control shaft 65 are located on the right hand side of a reference line L that passes through the axial center of the crankshaft 30 or on an opposite side of the cylinder axial line with respect to the reference line L and extends in parallel with the cylinder axial line, and the connecting point P between the lower link 60 and the control link 63 is also located on the right hand side of a reference line L as seen in FIG. 3.

The control shaft 65 supports the big end 63*b* of the control link 63 so as to be movable in the crankcase 4 within a prescribed range (about 90 degrees in the illustrated embodiment). The rotational angle of the control shaft 65 can be continually varied and retained at a desired angle by a rotary actuator AC (not shown in the drawing) provided on an axial end of the control shaft 65 extending out of the crankcase 4 according to the operating condition of the engine E.

In the engine E of the second embodiment, by rotatively actuating the control shaft 65, the position of the big end 63*b* of the control link 63 can be moved between the horizontally inward position illustrated in FIG. 3 and a vertically downward position (now shown in the drawings), and this causes a corresponding change in the swinging angle of the lower link 60 in response to the rotation of the crankshaft 30. Thereby, in response to the change in the swinging angle of the lower link 60, the stroke of the piston 11 in the cylinder or the top dead center and bottom dead center of the piston 11 change. In other words, a piston stroke varying mechanism is formed by the upper link 61, lower link 60, control link 63 and control shaft 65, and this provides the function to vary at least one of the compression ratio and displacement of the engine in a continuous manner.

A starter motor SM is mounted on the crankcase 4 in such a manner that, as seen from the axial direction of the crankshaft 30, the starter motor SM is located on an opposite side of the connecting point P between the lower link 60 and the control link 63 and/or an opposite side of the control shaft 65, or, in other words, on the left side of the reference line L as seen in FIG. 3. Thereby, according to the second embodiment of the present invention, the trajectory of the connecting point P, length of the control link 63 and position of the control shaft 65 can be optimally determined, and this allows an improvement of the engine performance.

FIG. 4 is a simplified front view showing the structure of a variable compression ratio engine given as a third embodiment of the present invention.

Referring to FIG. 5, in the engine E of the third embodiment, the control shaft 65 is located above the connecting point P between the lower link 60 and control link 63, and a starter motor SM is mounted on the crankcase 4 in such a manner that, as seen from the axial direction of the crankshaft 30, the starter motor SM is located below the connecting point P between the lower link 60 and control link 63. In particular, the wall of the crankcase 4 bulges outward in a part adjacent to the connecting point P between the lower link 60 and control link 63, and is relatively recessed in a part immediately below the bulging part. The starter motor SM is mounted on the recess part. Therefore, according to the third embodiment, the general protrusion of the crankcase 4 on this side is minimized and the mounting of the engine E in the engine room of a motor vehicle in a slanted orientation is facilitated.

FIG. 5 is a simplified front view showing the structure of a variable compression ratio engine given as a fourth embodiment of the present invention, and FIG. 6 is a simplified side view of the same.

Referring to FIGS. 5 and 6, the engine E of the fourth embodiment consists of an in-line four-cylinder engine, and has a transmission system TM attached to a rear end thereof. In the illustrated embodiment, to control the second-order and fourth-order vibrations of the engine, the control links 63 for the first and fourth cylinders are shorter than the control links 63' (indicated by the double-dot chain-dot lines) for the second and third cylinders. The upper links 61 and lower links 60 for the first and fourth cylinders are made to differ form those 4' and 5' (which are also indicated by the double-dot chain-dot lines) for second and third cylinders in length and configuration.

In the fourth embodiment, because the connecting point P between the control link 63 and lower link 60 is located below the connecting point P' between the control link 63' and lower link 60', the profile 4*a* of the crankcase 4 for the first and fourth cylinders each have a bulging part that extends upward from a lower part of the crankcase 4 only to a relative low part thereof while the profile 4*a'* of the crankcase 4*a* for the second and third cylinders jointly form a bulging part that extends upward from a lower part of the crankcase 4 to a relative high part thereof. Therefore, as seen from the axial direction, the upper part of the profile 4*a* of the crankcase 4 for the first and third cylinders is more recessed than the upper part of the profile 4*a'* of the crankcase 4 for the second and third cylinders. In particular, a relatively recessed part is defined in the profile 4*a* of the crankcase 4 for the fourth cylinder or adjacent to the transmission system TM above the bulging part thereof. The starter motor SM is thus mounted in this part or adjacent to the transmission system TM (or corresponding to the fourth cylinder) while avoiding the bulging profile 4*a'* of the crankcase 4 for the second and third cylinders and the overall profile of the engine is prevented to have any excessive protrusion.

FIG. 7 is a simplified front view showing the structure of a variable compression ratio engine given as a fifth embodiment of the present invention.

Referring to FIG. 7, in the engine E of the fifth embodiment, the control shaft 65 is located below the connecting point P between the lower link 60 and control link 63, and a starter motor SM is mounted on the crankcase 4 in such a manner that, as seen from the axial direction of the crankshaft 30, the starter motor SM is located above the connecting point P between the lower link 60 and control link 63. Also, in the fifth embodiment, the distance L1 from the connecting point P between the lower link 60 and control link 63 to the axial center of the crankshaft 30 is always smaller than the distance L2 from the axial center of the eccentric portion 65P of the control shaft 65 to the axial center of the crankshaft 30 so that the starter motor SM can be mounted in a relatively high part of the engine E. Therefore, according to the fifth embodiment of the present invention, the bulging of the crankcase 4 on each side thereof is minimized so that the mounting of the engine E in the engine room of a motor vehicle in a slanted orientation is facilitated.

As shown in FIGS. 8 to 12, the variable compression ratio engine E given as the sixth embodiment of the present invention consists of an automotive engine which is laterally placed (with a crankshaft 30 thereof oriented laterally with respect to the traveling direction of the motor vehicle) in the engine room of the motor vehicle not shown in the drawings. The engine E is mounted in the engine room in such a manner that the engine is somewhat tilted rearward or the cylinder axial line L-L is somewhat tilted rearward with respect to a vehicle line (See FIG. 9).

This variable compression ratio engine E consists of an in-line, four-cylinder, four-stroke OHC engine, and an engine main body 1 thereof comprises a cylinder block 2 formed with four cylinders 5 arranged laterally one next another, a cylinder head 3 integrally attached to a deck surface of the cylinder block 2 via a gasket 6, an upper block 40 (upper crankcase) integrally formed in a lower part of the cylinder block 2, and a lower block 41 (lower crankcase) integrally attached to the lower surface of the upper block 40. A crankcase 4 is jointly formed by the upper block 40 and the lower block 41. The upper surface of the cylinder head 3 is closed by a head cover 9 integrally attached thereby via a seal member 8, and an oil pan 10 is integrally attached to the lower surface of the lower block 41 (lower crankcase).

A piston 11 is slidably received in each of the four cylinders 5 of the cylinder block 2, and the part of the lower surface of the cylinder head 3 opposing the piston 11 is formed with a combustion chamber 12 and an intake port 14 and an exhaust port 15 communicating with the combustion chamber 12. An intake valve 16 is provided in the intake port 14, and an exhaust valve 17 is provided in the exhaust port 15, each configured to be selectively opened and closed as required. A valve actuating mechanism 18 is provided on the cylinder head 3 so as to open and close the intake valves 16 and exhaust valves 17. The valve actuating mechanism 18 comprises an intake camshaft 20 and exhaust camshaft 21 rotatably supported by the cylinder head 3, and an intake rocker arm 24 and exhaust rocker arm 25 that are rotatably supported by an intake rocker shaft 22 and exhaust rocker shaft 23, respectively, for each cylinder and functionally intervene between the intake camshaft 20 and intake valve 16 and between the exhaust camshaft 21 and exhaust valve 17, respectively. Thereby, the rotation of the intake and exhaust camshafts 20 and 21 causes the intake and exhaust valves 16 and 17 to be opened and closed at a prescribed timing via the rocking movements of the intake and exhaust rocker arms 24 and 25 against the valve closing forces of valve springs 26 and 27.

The intake camshaft 20 and exhaust camshaft 21 are actuated by a crankshaft 30 which is described hereinafter via a per se known synchronized transmission mechanism 28, and turn at half the rotational speed of the crankshaft 30. The valve actuating mechanism 18 is enclosed by the head cover 9 integrally attached to the upper surface of the cylinder head 3. The cylinder head 3 is provided with four cylindrical plug insertion tubes 31 so as to correspond to the four cylinders, and a spark plug 32 is inserted into the cylinder head 3 via each of these plug insertion tubes 3. The synchronized transmission mechanism 28 is covered by a chain case 29 which is attached to an end of the engine main body 1 corresponding to an axial end of the crankshaft 30.

The four intake ports 14 formed so as to correspond to the four cylinders 5 open out from the rear surface of the engine main body 1 or rearward with respect to the vehicle body, and are connected to an intake manifold 34 of an intake system IN. The intake system IN has a per se known structure, and detailed description of this part is omitted from this description.

The four exhaust ports 15 formed so as to correspond to the four cylinders 5 open out from the front surface of the engine main body 1 or forward with respect to the vehicle body, and are connected to an exhaust manifold 35 of an exhaust system EX. The exhaust system EX has a per se known structure, and detailed description of this part is omitted from this description.

The crankcase 4 consisting of the upper block 40 (upper crankcase) integrally formed in a lower part of the cylinder block 2 and the lower block 41 (lower crankcase) protrudes forwardly (with respect to the vehicle body) beyond the cylinders 5 of the cylinder block 2, and a crankcase chamber CC defined inside this protruding part accommodates a variable compression ratio mechanism CR (which is described hereinafter) that variably adjusts the stroke of the movement of the piston 11. A hydraulic actuator AC for driving this variable compression ratio mechanism CR is provided on the exterior of the engine main body 1, and is located at a position lower than the crankshaft 30.

As can be appreciated from FIGS. 8 and 9, forwardly of the engine E are provided an engine radiator RA on the right hand side of the vehicle body and an air conditioner radiator CO on the left hand side of the vehicle body. An engine radiator fan RF actuated by an electric motor 101 is provided centrally on the engine radiator RA, and an air conditioner radiator fan CF actuated by an electric motor 102 is provided centrally on the air conditioner radiator CO.

As shown in FIGS. 7 to 9, a heat shield plate 103 is attached to an exhaust side of the engine main body 1. The heat shield plate 103 consists of an upper part 103A and a lower part 103B, and the upper part 103A is attached to four mounting protrusions 104 extending from the engine main body 1 at four corners thereof by using four threaded bolts 105. The upper part 103A is intended as a heat shield cover for the exhaust manifold 35, and the lower part 103B integrally extending downward therefrom covers the front faces of the hydraulic actuator AC and a valve unit 92 which is described hereinafter.

As shown in FIGS. 13 and 16, the lower block 41 is attached to the lower surface of the upper block 40, which is integrally formed with the lower part of the cylinder block 2, by using a plurality of connecting bolts 42. A plurality of journal bearings 43 are formed in the interface between the upper block 40 and lower block 41 to support the journals 30J of the crankshaft 30 in a rotatable manner.

As shown in FIG. 13, the lower block 41 consists of a cast member having a rectangular closed cross section as seen in plan view, and is provided with end bearing members 50 and 51 on the left and right ends thereof, respectively, a central bearing member 54 in a central part thereof, and left and right intermediate bearing members 52 and 53 in intermediate parts thereof. The journals 30J of the crankshaft 30 are supported by these bearing members 50 to 54.

Now referring to FIGS. 11 and 12 once again, the structure of the variable compression ratio mechanism CR for varying the top dead center and bottom dead center positions of the piston 11 and hence the compression ratio between a high compression ratio and a low compression ratio is described in the following.

The crankshaft 30, which is rotatably supported in the interface between the upper block 40 and lower block 41 as discussed earlier, is provided with crankpins 30P, and each crankpin 30P pivotally supports an intermediate part of a triangular lower link 60. An end (upper end) of the lower link 60 is pivotally connected to a lower end (big end) of an upper link (connecting rod) 61 via a first connecting pin 62, and the upper link 61 is in turn pivotally connected to a piston pin 13 of the piston 11. Another end (lower end) of the lower link 60 is pivotally connected to an upper end of a control link 63 via a second connecting pin 64. The control link 63 extends downward, and has a lower end which is pivotally connected to an eccentric pin 65P of a crank-shaped control shaft 65. The control shaft 65 is integrally and coaxially connected to the hydraulic actuator AC (which is described hereinafter) so that the control shaft 65 may be angularly actuated by the hydraulic actuator AC over a prescribed angular range (90 degrees, for instance). The resulting phase shift of the eccentric pin 65P causes the control link 63 to be angularly actuated. More specifically, the control shaft 65 can angularly displace between a first position (where the eccentric pin 65P is at a lower position) illustrated in FIG. 10 and a second position (where the eccentric pin 65P is at a higher position) illustrated in FIG. 11. At the first position illustrated in FIG. 10, because the eccentric pin 65P is at a lower position, the control link 63 is pulled down, and the lower link 60 is tilted in clockwise direction around the crankpin 30P of the crankshaft 30. Therefore, the upper link 61 is pushed upward and the piston 11 assumes a higher position with respect to the cylinder 5 so that the engine E is placed under a high compression ratio condition. Conversely, at the second position illustrated in FIG. 11, because the eccentric pin 65P is at a higher position, the control link 63 is pushed up, and the lower link 60 is tilted in counter clockwise direction around the crankpin 30P of the crankshaft 30. Therefore, the upper link 61 is pulled downward and the piston 11 assumes a lower position with respect to the cylinder 5 so that the engine E is placed under a low compression ratio condition. Thus, an angular displacement of the control shaft 65 around its axial center causes an angular displacement of the control link 63 which in turn causes a change in the constraint on the movement of the lower link 60 so that the stroke property of the piston 11 including the top dead center position is varied, and this enables the compression ratio of the Engine E to be changed at will.

Thus, the variable compression ratio mechanism CR is formed by the upper link 61, first connecting pin 62, lower link 60, second connecting pin 64 and control link 63.

As shown in FIGS. 13 and 15, the control shaft 65 which is connected to the control link 63 and actuates the variable compression ratio mechanism CR is formed as a crankshaft including a plurality of journals 65J and eccentric pins 65P arranged in an alternating fashion, similarly as the engine crankshaft 30. To an end of this control shaft 65 is coaxially connected the hydraulic actuator AC which is described herein after so that the control shaft 65 may be actuated by the hydraulic actuator AC. The control shaft 65 extends in parallel with the crankshaft 30, and is rotatably supported, at a position lower than the crankshaft 30, by the lower block 41 and a bearing block 70 attached to the lower surface of the lower block 41 by using a plurality of connecting bolts 68.

As shown in FIG. 15, the bearing block 70 supporting the control shaft 65 consists of an integrally cast member given with a high rigidity and includes a connecting member 71 extending in the axial direction of the control shaft 65 and a plurality of bearing walls 72 that extend perpendicularly from the connecting member 71 at a regular axial interval. The journals 65J of the control shaft 65 are rotatably supported, via slide bearings, by the bearing portions formed between the upper surfaces of the bearing walls 72 and the lower surfaces of bearing walls 50*a*, 51*a*, 52*a*, 53*a* and 54*a* extending from the respective bearing members 50, 51, 52, 53 and 54 of the lower block 41.

The structure of the hydraulic actuator AC for driving the control shaft 65 is now described in the following.

As shown in FIGS. 8, 9, 13, 14 and 15, the hydraulic actuator AC has a housing HU which is fixedly attached to an end surface of the engine main body 1 or in particular the lower block 41 thereof corresponding to an axial end of the crankshaft 30 by using a plurality of fastening bolts 93 with the chain case 29 covering the synchronized transmission mechanism 28 interposed between the housing HU and the lower block 41. The housing HU is provided with a hexagonal shape, and includes an inner housing HUi and an outer housing HUo that are joined to each other with a packing or gasket interposed between them to internally define a cylindrical vane chamber 80 therein. The vane chamber 80 receives a vane shaft 66 serving as a drive shaft and an internal end of the vane shaft 66 is connected to an end of the control shaft 65 via a spline coupling in a coaxial relationship so that the torque of the vane shaft 66 can be directly transmitted to the control shaft 65.

As shown in FIG. 14, a pair of sector shaped vane oil chambers 86 are defined at a 180 degree phase difference between the inner circumferential surface of the vane chamber 80 and the outer circumferential surface of the vane shaft (drive shaft) 66. A pair of vanes 87 extending from the outer circumferential surface of the vane shaft 66 are received in the corresponding vane oil chambers 86. The outer circumferential surface of each vane 87 engages the inner circumferential surface of the corresponding vane oil chamber 86 via a packing so that each vane 87 separates the corresponding vane oil chamber 86 into two control oil chambers 86*a* and 86*b* in a liquid tight manner. The housing HU is formed with oil passages 88 and 89 communicating with the control oil chambers 86*a* and 86*b*, respectively, and these oil passages 88 and 89 are also connected to a solenoid switching valve V of a hydraulic circuit which will be described hereinafter.

As shown in FIGS. 8, 13 and 14, the front face of the engine main body 1 is formed with a flat mounting surface 90 adjacent to the hydraulic actuator AC, and a valve unit 92 receiving the solenoid switching valve V (see FIG. 17) of the hydraulic circuit for the hydraulic actuator AC therein is mounted on this mounting surface 90 by using a plurality of threaded bolts 91.

The hydraulic circuit for the hydraulic actuator AC for controlling the variable stroke link mechanism CR is described in the following with reference to FIG. 17.

As discussed earlier, the two sector shaped vane oil chambers 86 are each separated into the two control oil chambers 86*a* and 86*b* by the corresponding vane 87, and these control oil chambers 86*a* and 86*b* are connected to an oil tank T via the hydraulic circuit which will be described hereinafter. To the hydraulic circuit are connected an oil pump P, a check valve C, an accumulator A and the solenoid switching valve V. The oil pump P, check valve C, accumulator A and solenoid switching valve V form an oil pressure supply device S, and are placed in appropriate parts of the engine main body 1. The solenoid switching valve V is provided inside the valve unit 92 described earlier. The oil pressure supply device S is connected to the solenoid switching valve V via a pair of pipes P1 and P2, and the solenoid switching valve V is connected to the control oil chambers 86*a* and 86*b* via the oil passages 88 and 89 formed in the housing HU. Therefore, in FIG. 10, when the solenoid switching valve V is switched to a left position, the hydraulic pressure produced by the oil pump P is forwarded to the control oil chamber 86*a*, and this hydraulic pressure pushes the vane 87 in the direction to turn the control shaft in counter clockwise direction. Conversely, when the solenoid switching valve V is switched to a right position, the hydraulic pressure produced by the oil pump P is forwarded to the control oil chamber 86*b*, and this hydraulic pressure pushes the vane 87 in the direction to turn the control shaft in clockwise direction. Thereby, the phase of the eccentric pin 65P can be changed as desired. To the eccentric pin 65P of the control shaft 65 is pivotally connected the control link 63 of the variable compression ratio mechanism CR so as to enable an angular movement of the control shaft 65 around its axial line. Therefore, by suitably actuating the control shaft 65 (about 90 degrees), the resulting change in the phase of the eccentric pin 65P of the control shaft 65 operates the variable compression ratio mechanism CR in a corresponding manner.

The hydraulic actuator AC and valve unit 92 are provided in the proximity of the exhaust manifold 35 and radiator RA which emit significant amounts of heat. Therefore, there is a concern that the heat from the exhaust manifold 35 and radiator RA may raise the temperatures of the hydraulic actuator AC and valve unit 92 to such an extent that oil leakage may increase owing to the decrease in the viscosity of the hydraulic oil, and degradation of various parts such as seal members, hydraulic oil, electric and electronic components for the control system may be accelerated. However, according to the illustrated embodiment, the head shield plate 103 is provided between the exhaust manifold 35 and radiator RA which emit significant amounts of heat and the hydraulic actuator AC and valve unit 92. The head shield plate 103 shuts off the radiation of heat from the heat sources and prevents an undesired increase in the temperatures of the hydraulic actuator AC and valve unit 92 so that the aforementioned problems associated with heat can be effectively avoided.

In particular, because the heat shield plate 103 serving as a heat shield cover for the exhaust manifold 35 is extended downward so as to prevent an undesired increase in the temperatures of the hydraulic actuator AC and valve unit 92, the number of required component parts can be minimized, and the overall structure can be simplified.

Also, because the hydraulic actuator AC and valve unit 92 are located outside of the projected area of the radiator fan RF and exhaust manifold 35 as seen from the front (see FIG. 10), the air whose temperature is increased owing to the passage through the radiator RA and exhaust manifold 35 is prevented from directly impinging upon the hydraulic actuator AC and valve unit 92.

A seventh embodiment of the present invention is described in the following with reference to FIG. 18.

The seventh embodiment differs from the sixth embodiment in the shape of the heat shield plate 103. The heat shield plate 103 of the seventh embodiment is provided with a wind guiding part 103C. Owing to the wind guiding part 103C, the air flow from the front end of the vehicle body owing to the motion of the vehicle is guided along the lower surface of the wind guiding part 103C onto the hydraulic actuator AC and valve unit 92 so that these parts are even more effectively cooled.

FIGS. 19 and 20 show an eighth embodiment of the present invention. FIG. 19 is a view similar to FIG. 9, and FIG. 20 is a view as seen from the direction indicated by line XX-XX in FIG. 19.

Whereas the heat shielding cover for the exhaust manifold 35 was used as the heat shield plate 103 in the sixth and seventh embodiments, a dedicated heat shield plate 103 along with a wind guiding plate 106 that cooperates with the heat shield plate 103 is used in the eighth embodiment.

The heat shield plate 103 that covers the hydraulic actuator AC and valve unit 92 is attached to the lower block 41 by using threaded bolts 107 so as to shield the hydraulic actuator AC and valve unit 92 from the exhaust manifold 35. The wind guiding plate 106 attached to the lower block 41 by using threaded bolts 108 under the heat shield plate 103 is disposed such that the air flow from the front end of the vehicle body owing to the motion of the vehicle is guided to the rear surface of the heat shield plate 103. On account of the wind guiding plate 106, the air flow owing to the motion of the vehicle can be effectively utilized for cooling the hydraulic actuator AC and valve unit 92 while ensuring the heat shielding function of the heat shield plate 103.

The heat shield plate 103 may also be attached to the fan cover of the radiator RA instead of the engine E, and the wind guiding plate 106 may also be attached to the vehicle body instead of the engine E.

FIGS. 21 and 22 show a ninth embodiment of the present invention. FIG. 21 is a view similar to FIG. 9, and FIG. 22 is a view as seen from the direction indicated by line XXII-XXII in FIG. 21.

The exhaust manifold 35 was located on the front side of the vehicle body, and the intake manifold was located on the rear side of the vehicle body in the eighth embodiment, but the arrangement is reversed in the ninth embodiment. More specifically, the exhaust manifold 35 is located on the rear side of the vehicle body, and the intake manifold 34 is located on the front side of the vehicle body. In this case, the exhaust manifold 35 does not act as a harmful heat source for the hydraulic actuator AC and valve unit 92, but the radiator RA may act as a harmful heat source.

However, by arranging the heat shield plate 103 and wind guiding plate 106 similarly as the eighth embodiment, the hydraulic actuator AC and valve unit 92 can be cooled by shielding the heat radiation from the radiator RA with the heat shield plate 103 and guiding the wind caused by the motion of the vehicle onto the hydraulic actuator AC and valve unit 92 with the wind guiding plate 106.

FIGS. 23 to 28 show a tenth embodiment of the present invention. FIG. 23 is an overall perspective view of the variable stroke engine, FIG. 24 is a view as seen from the direction indicated by XXIV in FIG. 23, FIG. 25 is a view as seen from the direction indicated by line XXV-XXV in FIG. 24, FIG. 26 is a view as seen from the direction indicated by line XXCVI-XXVI in FIG. 25, FIG. 27 is a view as seen from the direction indicated by line XXVII-XXVII in FIG. 25, and FIG. 28 is a cooling system circuit diagram of the hydraulic actuator.

Whereas the hydraulic actuator AC for actuating the control shaft 65 was exposed on the right side of the engine main body 1 in the sixth to ninth embodiment, the hydraulic actuator AC is provided inside the crankcase chamber CC of the engine main body 1 in the tenth embodiment.

More specifically, as shown in FIGS. 23 to 28, the housing HU for the hydraulic actuator AC for actuating the control shaft 65 is provided in a bulging part 58 formed on one side of a central bearing member 54 (which is integrally attached to the upper block 40 and lower block 41). A vane shaft 66 formed in an longitudinally central part of the control shaft 65 is received in a vane case 79 integrally formed in the housing HU, and a pair of vanes 87 integrally project from the outer circumferential surface of the vane shaft 66 at a phase difference of about 180 degrees. The two ends of the vane shaft 66 are rotatably supported by cover members 81 and 82, respectively, which are attached to either side of the housing HU by using a plurality of threaded bolts 83. Openings on either side of the housing HU are closed by the cover members 81 and 82.

A pair of sector shaped vane oil chambers 86 are defined at a 180 degree phase difference between the inner circumferential surface a vane case 79 and the vane shaft 66, and a pair of vanes 87 extending from the outer circumferential surface of the vane shaft 66 are received in the corresponding vane oil chambers 86. Each vane 87 separates the corresponding sector shaped vane oil chamber 86 into two control oil chambers 86*a* and 86*b* in a liquid tight manner. The vane shaft 66 along with the control shaft 65 can thus be turned within a prescribed angular range by selectively feeding and removing hydraulic oil from these control oil chambers 86*a* and 86*b* by using a hydraulic circuit which is described hereinafter.

The upper surface of the housing HU formed on the central bearing member 54 is provided with a planar mounting surface 90 that expands wider from the bearing portion 54A of the crankshaft 30 to the end of the housing HU in the shape of a dovetail, and the valve unit 92 of the hydraulic control circuit for the hydraulic actuator AC is fixedly mounted on this mounting surface 90 by using a plurality of threaded bolts 91. The valve unit 92 is passed through a wall of the cylinder block 2 and is exposed from an upper surface thereof. Thereby, the valve unit 92 can be firmly secured to the mounting surface of the housing HU, and is exposed on all sides on the mounting wall of the cylinder block 2, and this facilitates the servicing of the valve unit 92.

A heat shield plate 103 interposed between the front side of the engine main body 1 and exhaust manifold 35 comprises an upper part 103A, a lower part 103B and a wind guiding part 103C. The upper part 103A is attached to upper projections 104 of the engine main body 1 by using threaded bolts 105, and serves as a heat shielding cover for the exhaust manifold 35. The lower part 103B is attached to the upper block 40 and lower block 41 by using threaded bolts 56, and performs the function to protect the hydraulic actuator AC and valve unit 92 from the heat radiation from the exhaust manifold 35 and radiator RA. The wind guiding part 103C extends forward from the lower end of the lower part 103B, and performs the function to guide the wind caused by the motion of the vehicle to the hydraulic actuator AC and valve unit 92.

In particular, the threaded bolts 56 that secure the heat shield plate 103 to the lower block 41 secure the intermediate bearing member 54 to the lower block 41 so that the number of components can be reduced. Because the heat shield plate 103 is attached to both the hydraulic actuator AC and the valve unit 92, the supporting rigidity for the heat shield plate 103 can be improved.

As shown in FIG. 28, most of the cooling water expelled from a cooling water pump 109 passes through a water jacket W1 of the cylinder head 3 and a water jacket W2 of the cylinder block 2, and after exchanging heat with these parts of the engine E flows into an upper part of the radiator RA. The cooling water is cooled by the wind that passes through the radiator RA and returns to the cooling water pump 109 from a lower part of the radiator RA.

A part of the cooling water that is expelled from the cooling water pump 109 is supplied to a water jacket W3 formed in the central bearing member 54 along a part of the outer periphery of the hydraulic actuator AC.

By thus using the cooling water to cool the hydraulic actuator AC and valve unit 92, an even more reliable cooling effect can be obtained than by using only the wind resulting from the motion of the vehicle for cooling them. In particular, by forming the water jacket W3 along a part of the outer periphery of the hydraulic actuator AC, an improved cooling effect can be obtained. Furthermore, because the upper part 103A of the heat shield plate 103 extends along the cooling water passages 110 and 111 formed in the upper block 40, the rise in the temperature of the cooling water flowing through the cooling water passages 110 and 111 can be reduced, and the cooling effect for the hydraulic actuator AC and valve unit 92 can be improved even further.

The eleventh embodiment of the present invention is described in the following with reference to FIG. 29.

In the eleventh embodiment, the intake manifold 34 is provided on the front side of the engine E similarly as the ninth embodiment described in connection with FIGS. 21 and 22. The heat shield plate 103 interposed between the exhaust manifold 35 acting as a heat source and the hydraulic actuator AC and valve unit 92 is formed by extending a stay for supporting the intake manifold 34 on the engine block 1 downward far enough to cover the hydraulic actuator AC and valve unit 92. The lower end of the heat shield plate 10 is secured, for instance, to the lower block 41 by using threaded bolts 112.

By thus using an intake system component part such as the stay of the intake manifold 34 as a heat shield plate 103, the number of component parts can be reduced. The stay is not necessarily required to be integral with the intake manifold 34 but may be secured thereto by using a fastening means such as threaded bolts.

This concludes the description of the various embodiments of the present invention, but it should be appreciated that the present invention is not limited by such embodiments and variations described above but may be implemented in variously different ways. For instance, the foregoing embodiments and modified embodiments were directed to in-line four-cylinder engines, but the present invention is equally applicable to V-type engines as well. Also, the specific structure of the variable stroke mechanism can be freely modified without departing from the spirit of the present invention.

For instance, the actuator of the present invention is not limited to hydraulic actuators such as the one used in the illustrated embodiments, but may also consist of various electric actuators.

The present invention was applied to a variable compression ratio engine E which varies the top dead center of the piston 11 by changing the phase of the eccentric pin 65P of the control shaft 65 in the foregoing embodiments, but may also be applied to other forms of variable stroke engines. For instance, the present invention may be applied to an engine in which the control shaft 65 is continually rotatively actuated at half the speed of the crankshaft 30 and the phase relationship between the crankshaft 30 and control shaft 65 is changed so that the position and stroke of the engine in each of the intake, compression, expansion and exhaust strokes may be varied as desired.

A further improvement in the heat shielding effect can be achieved by extending the exhaust manifold 34 that serves as a heat shield means downward. The heat shield means may include an air cleaner or a resonator as well as the intake manifold 34.

The contents of the original Japanese patent applications on which the Paris Convention priority claim is made for the present application are incorporated in this application by reference.

Figure 1:
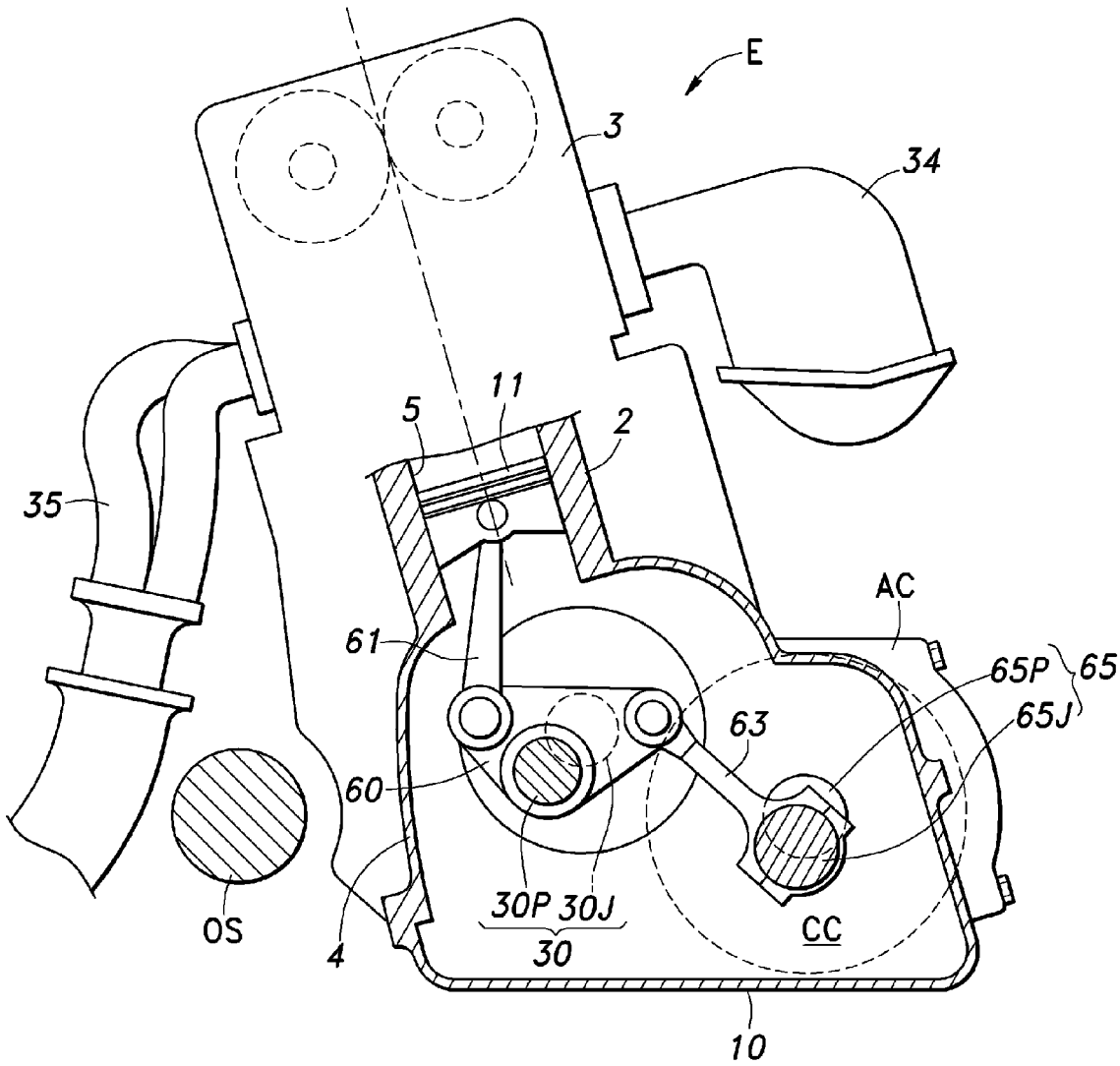
FIG. 1 is a front view of a variable stroke engine given as a first embodiment of the present invention partly in section.
Figure 2:
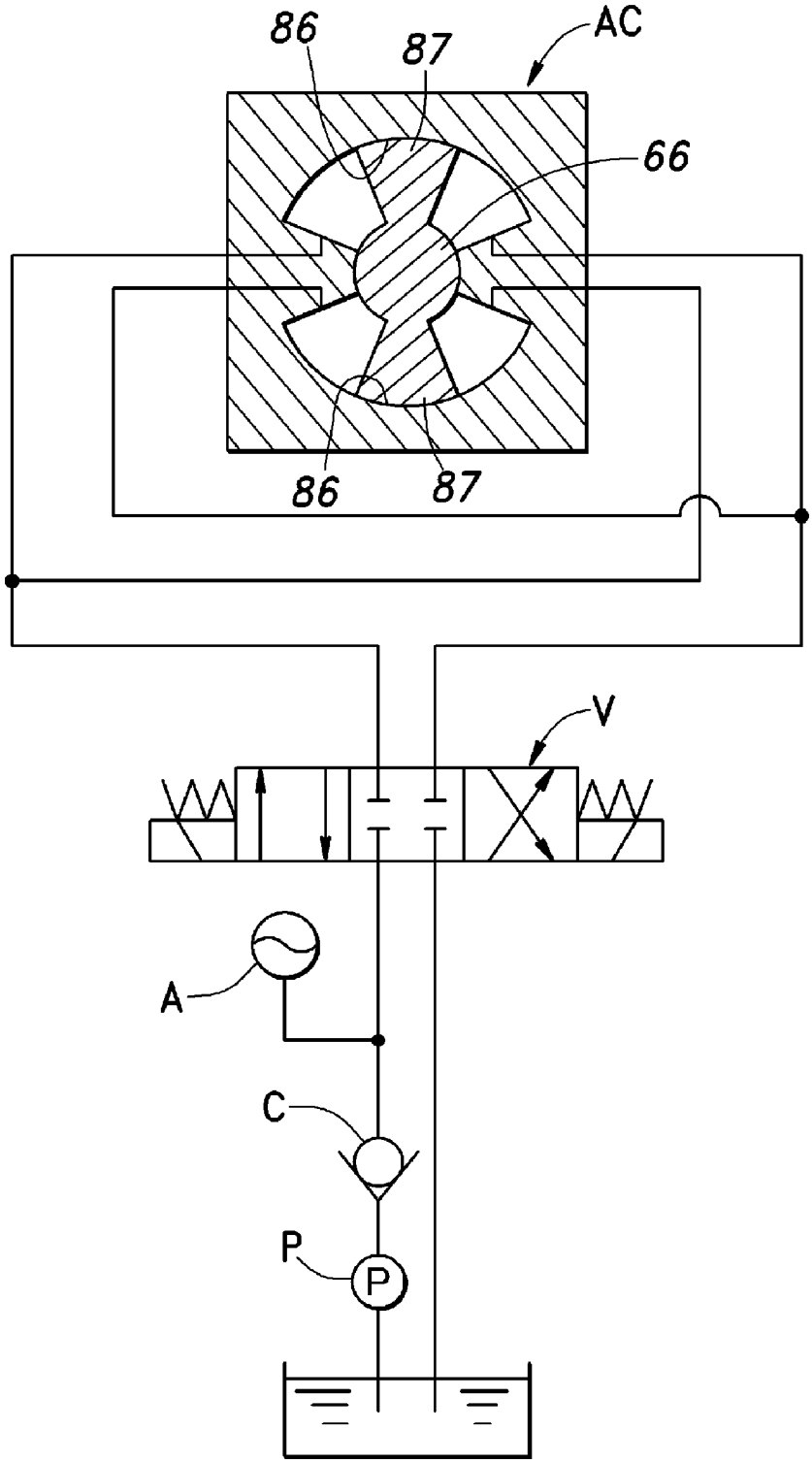
FIG. 2 is a hydraulic circuit for the actuator for the engine of FIG. 1.
Figure 3:
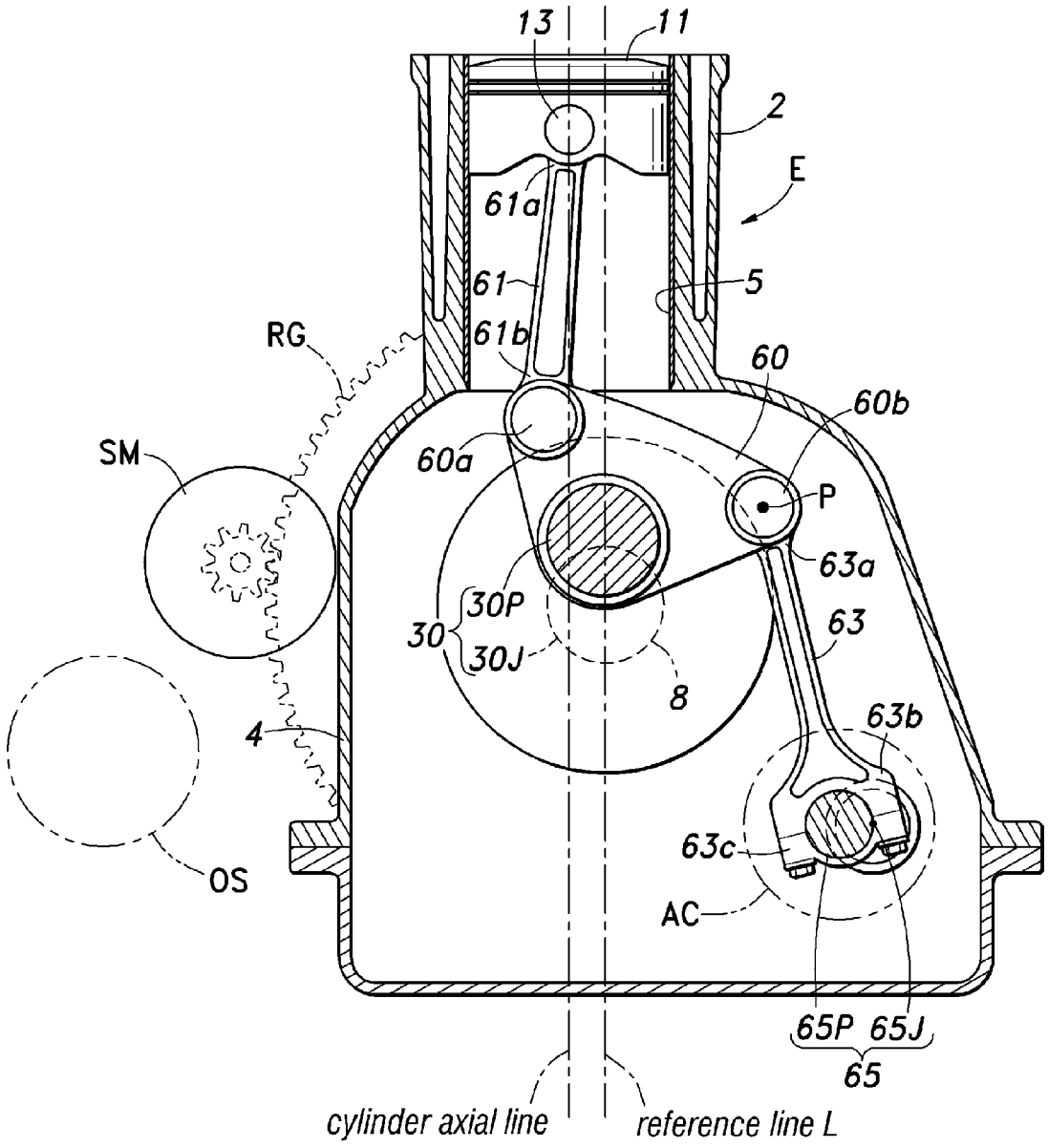
FIG. 3 is a vertical sectional view showing the structure of a variable stroke engine given as a second embodiment of the present invention.
Figure 4:
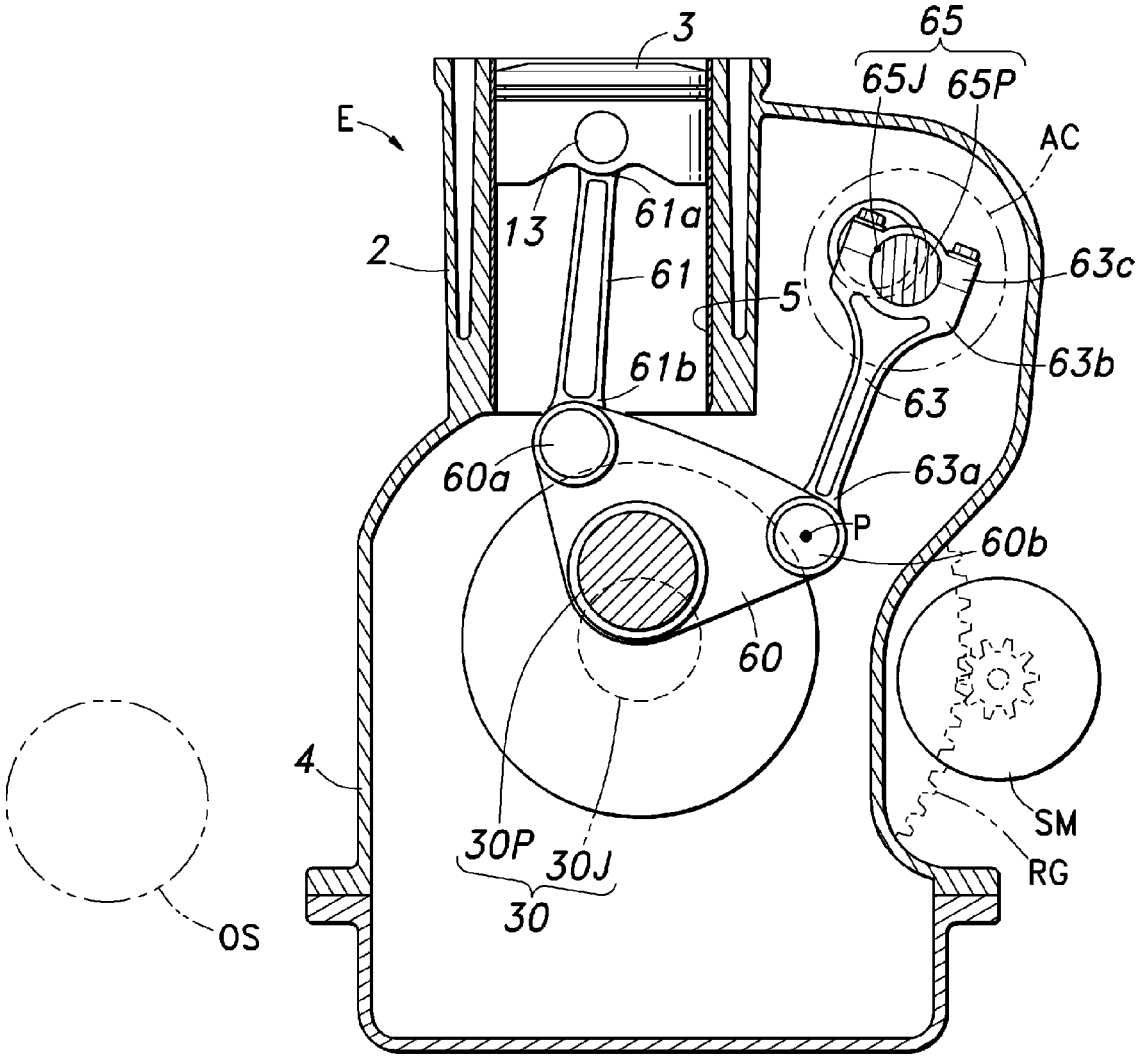
FIG. 4 is a vertical sectional view showing the structure of a variable stroke engine given as a third embodiment of the present invention.
Figure 5:
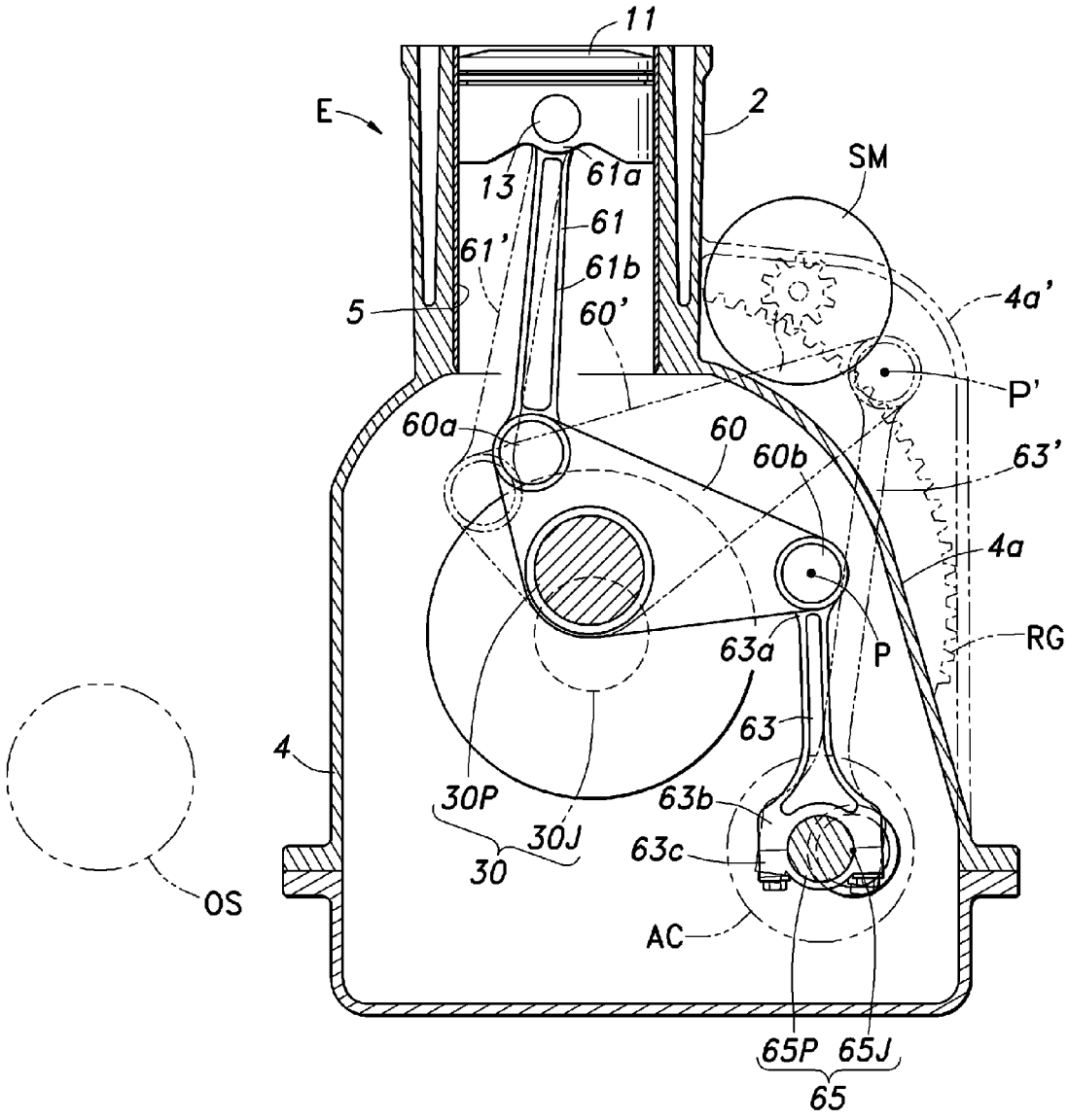
FIG. 5 is a vertical sectional view showing the structure of a variable stroke engine given as a fourth embodiment of the present invention.
Figure 6:
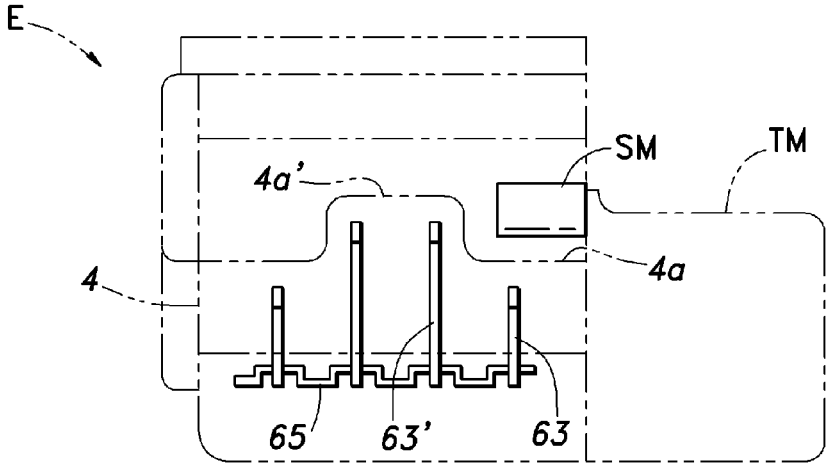
FIG. 6 is a side view of the engine shown in FIG. 5 partly in section.
Figure 7:
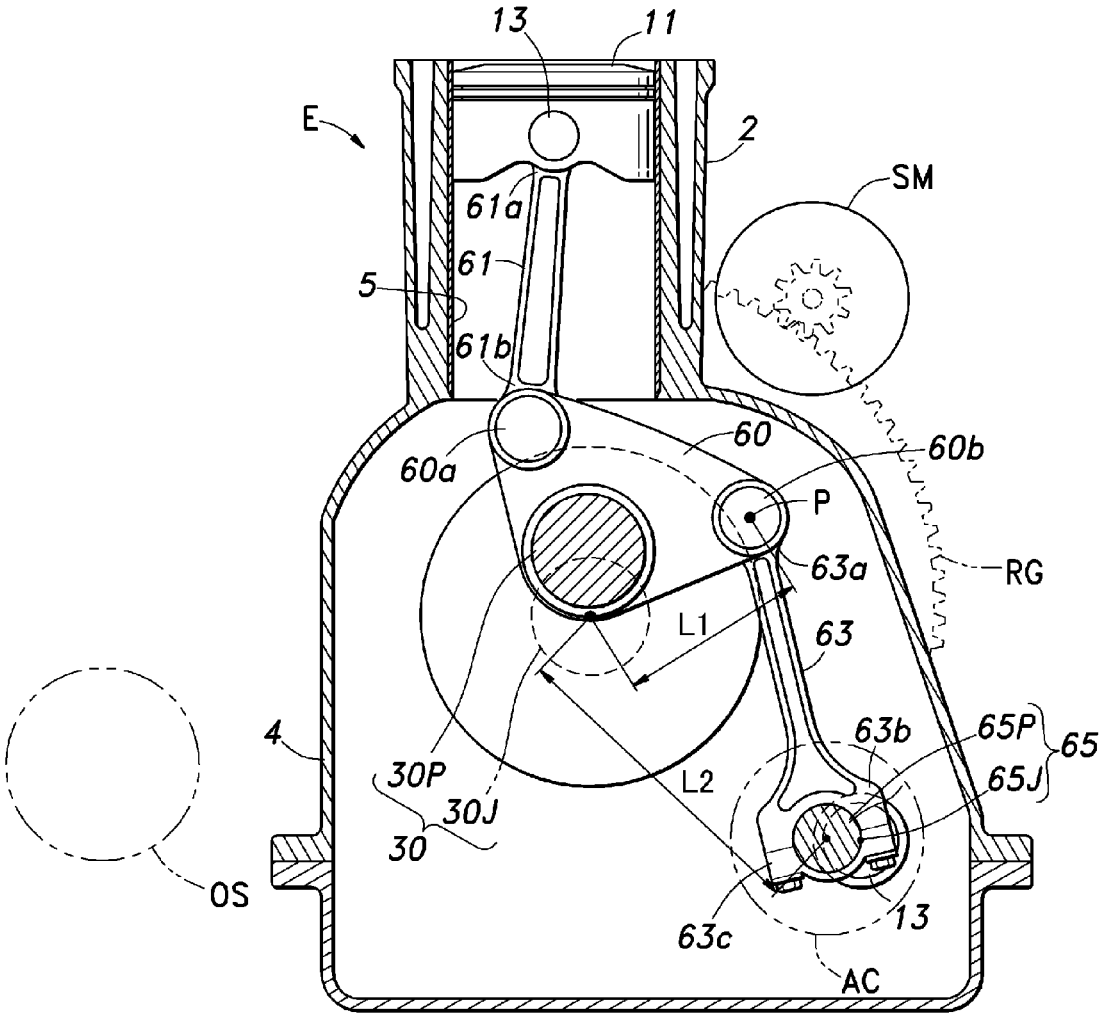
FIG. 7 is a vertical sectional view showing the structure of the variable stroke engine given as the fifth embodiment of the present invention.
Figure 8:
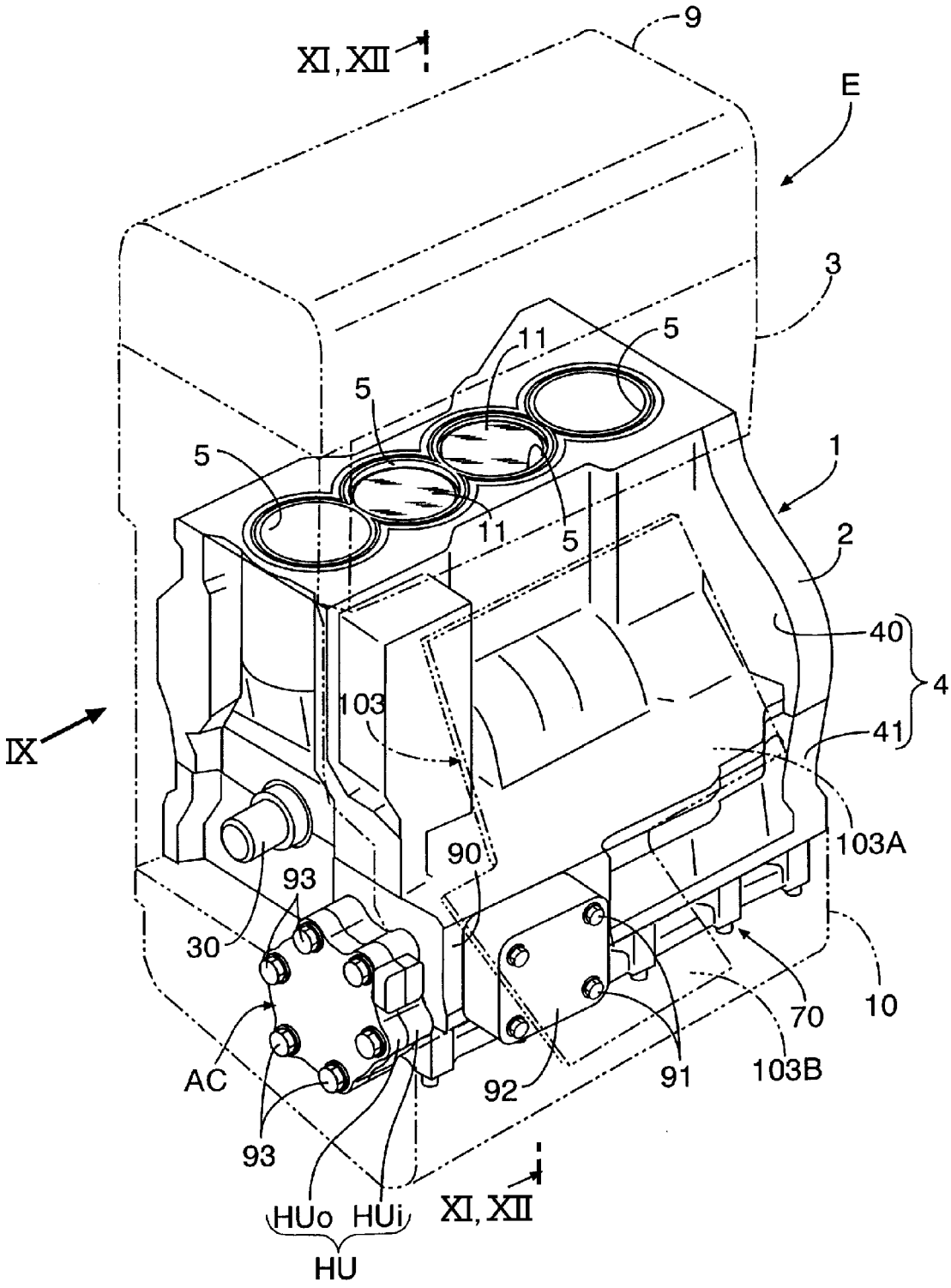
FIG. 8 is an overall perspective view showing the structure of the variable stroke engine given as the sixth embodiment of the present invention.
Figure 9:
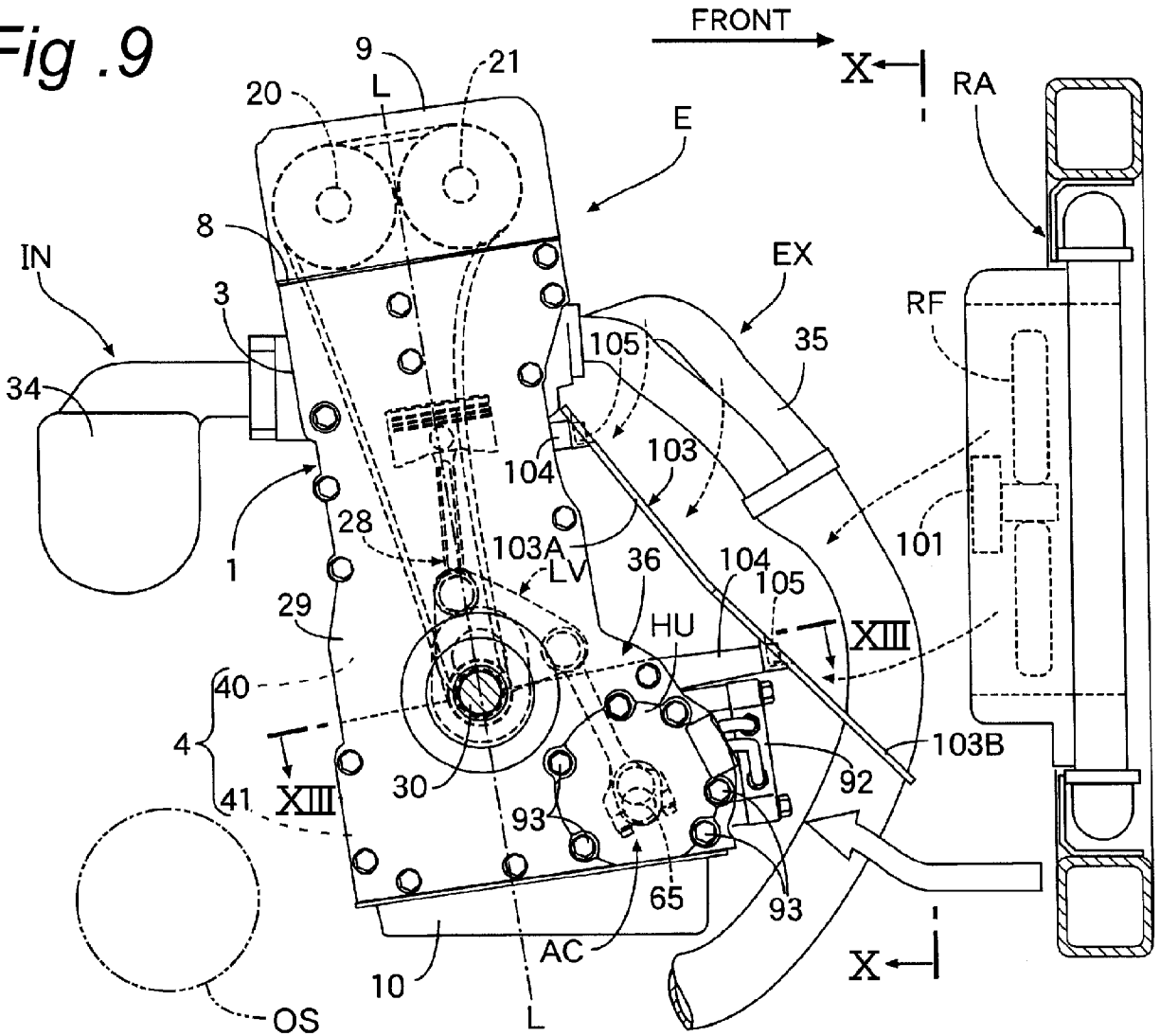
FIG. 9 is a view as seen from the direction indicated by IX in FIG. 8.
Figure 10:
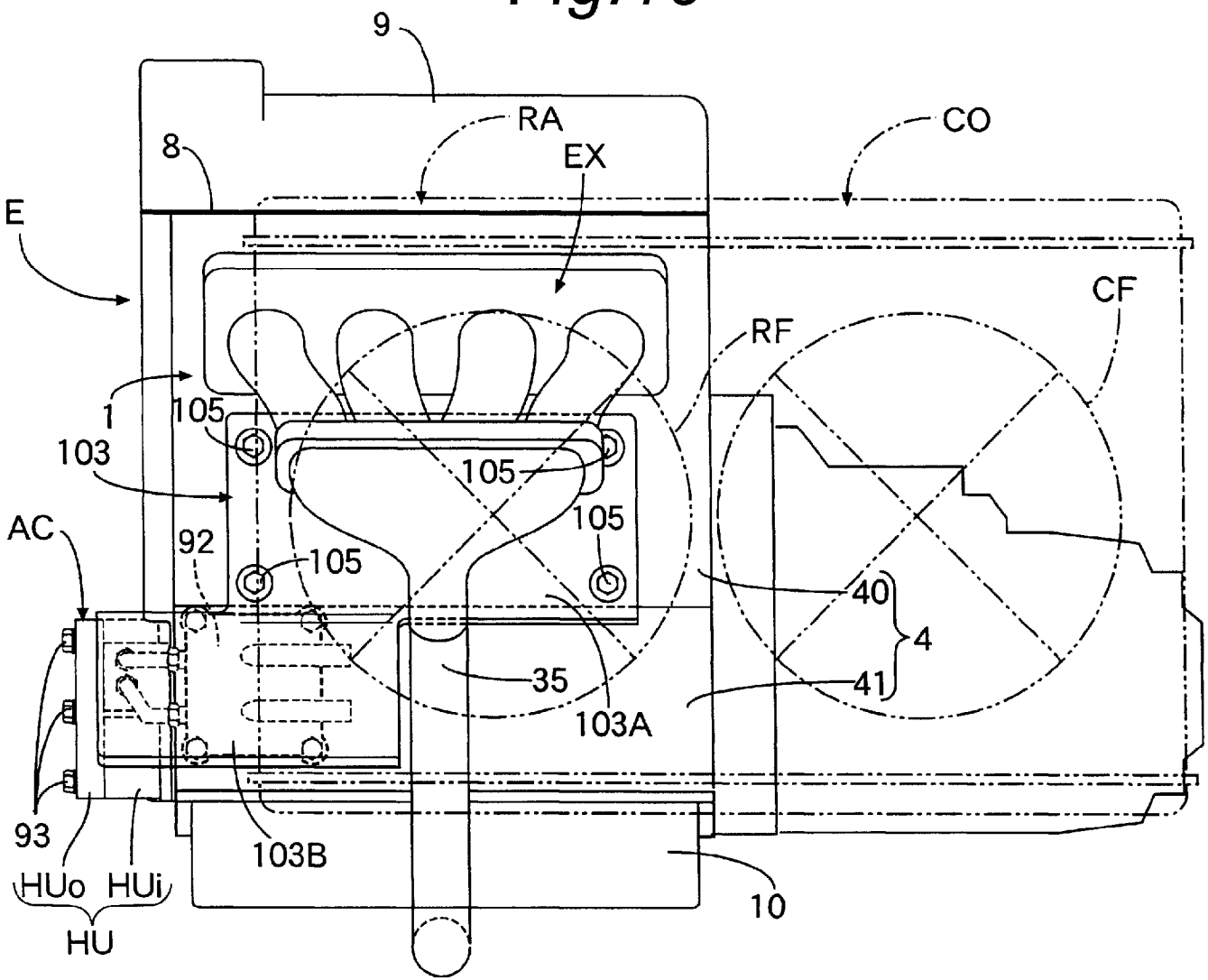
FIG. 10 is a view as seen from the direction indicated by line X-X in FIG. 9
Figure 11:
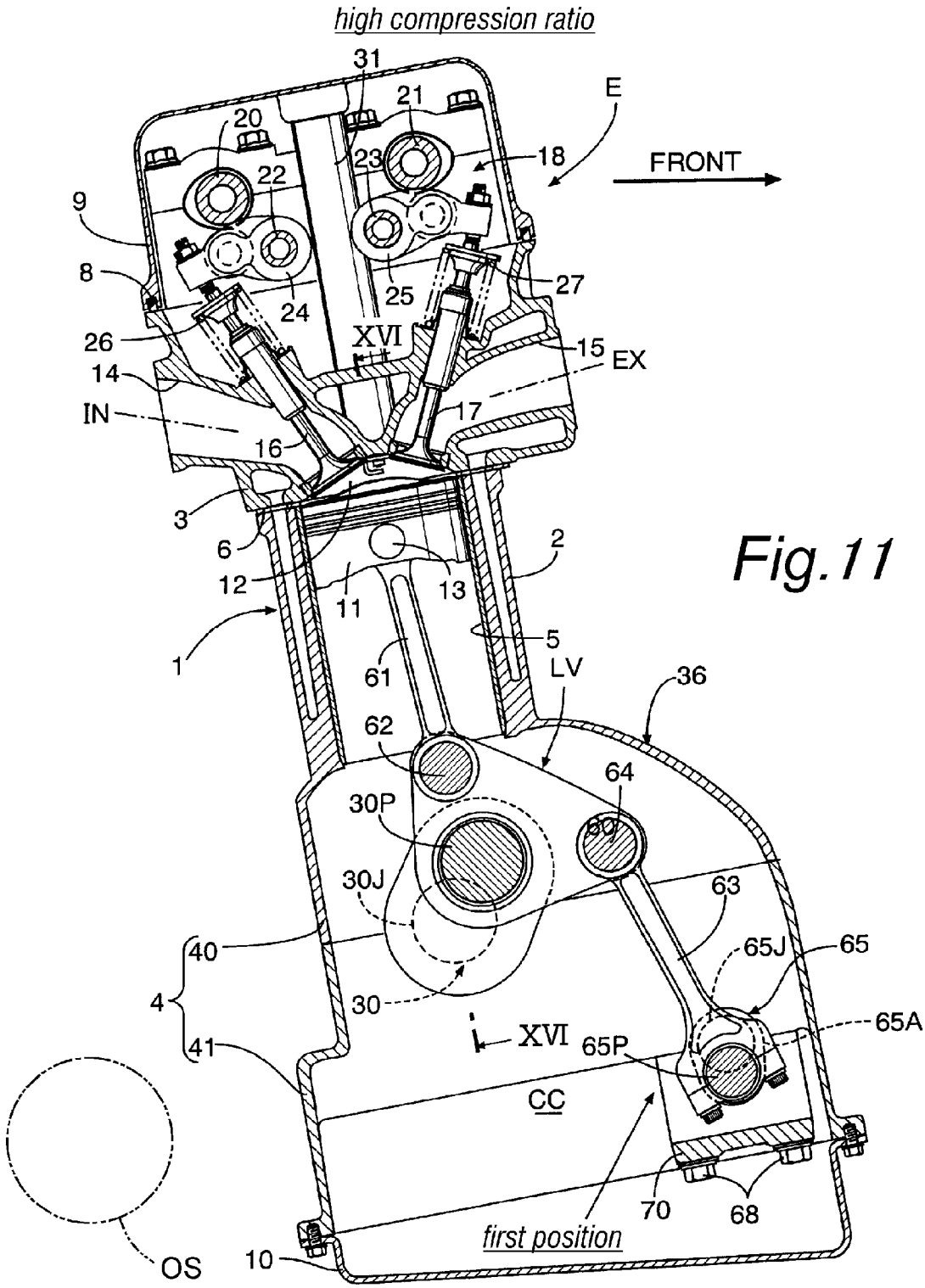
FIG. 11 is a sectional view taken along line XI-XI in FIG. 8 (high compression ratio condition)
Figure 12:
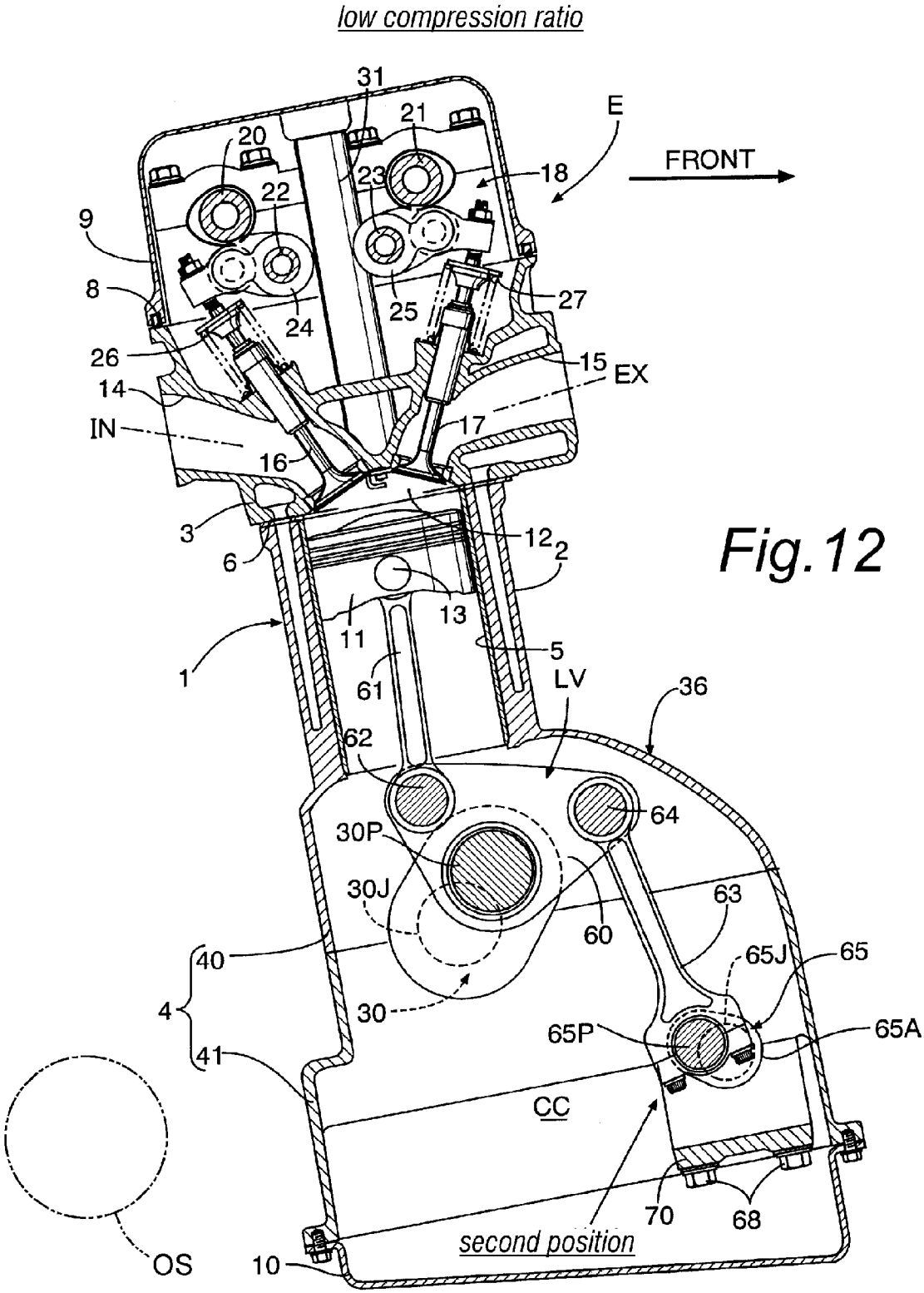
FIG. 12 is a sectional view taken along line XII-XII in FIG. 8 (low compression ratio condition)
Figure 13:
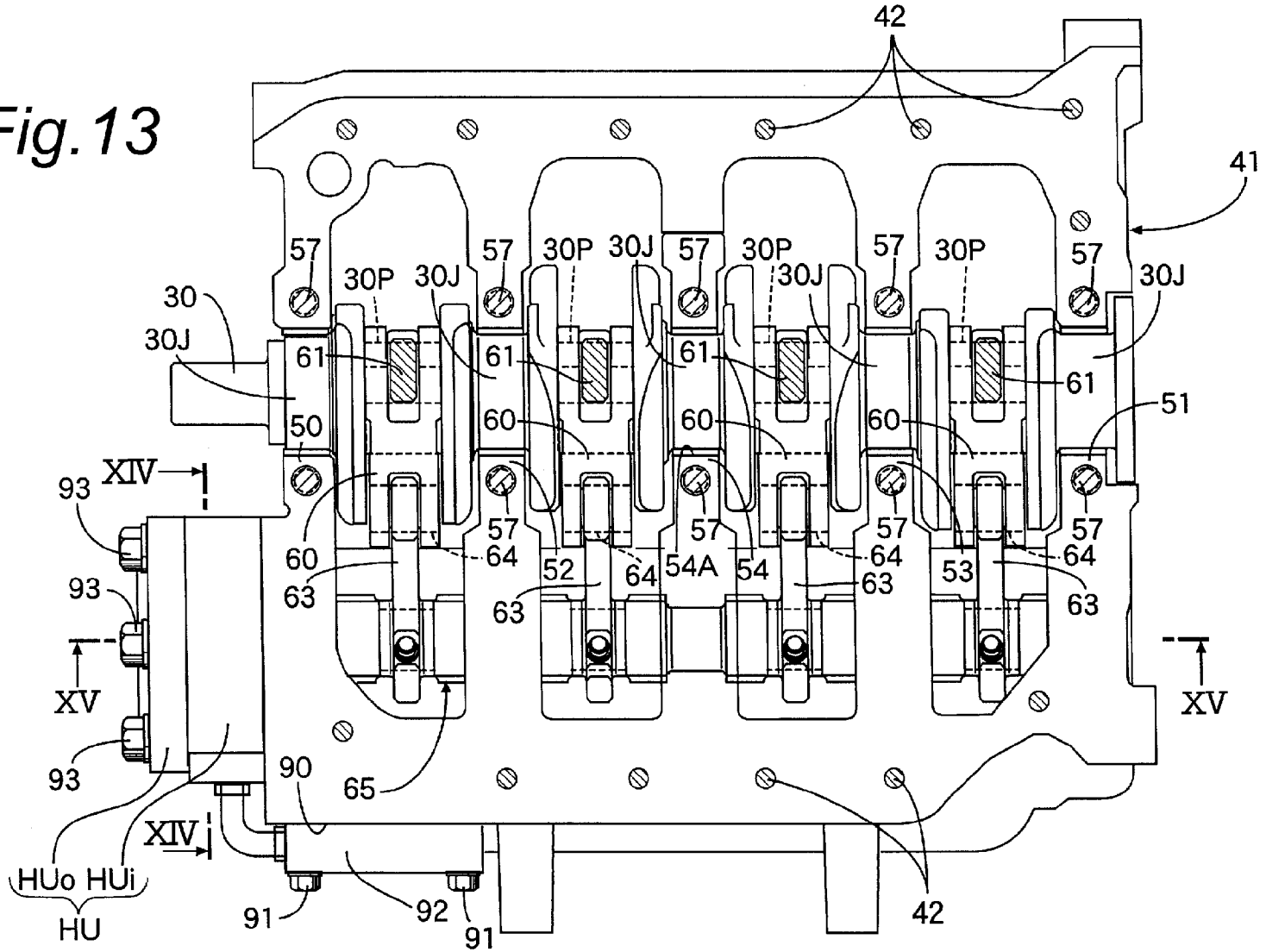
FIG. 13 is a view as seen from line XIII-XIII in FIG. 9.
Figure 14:
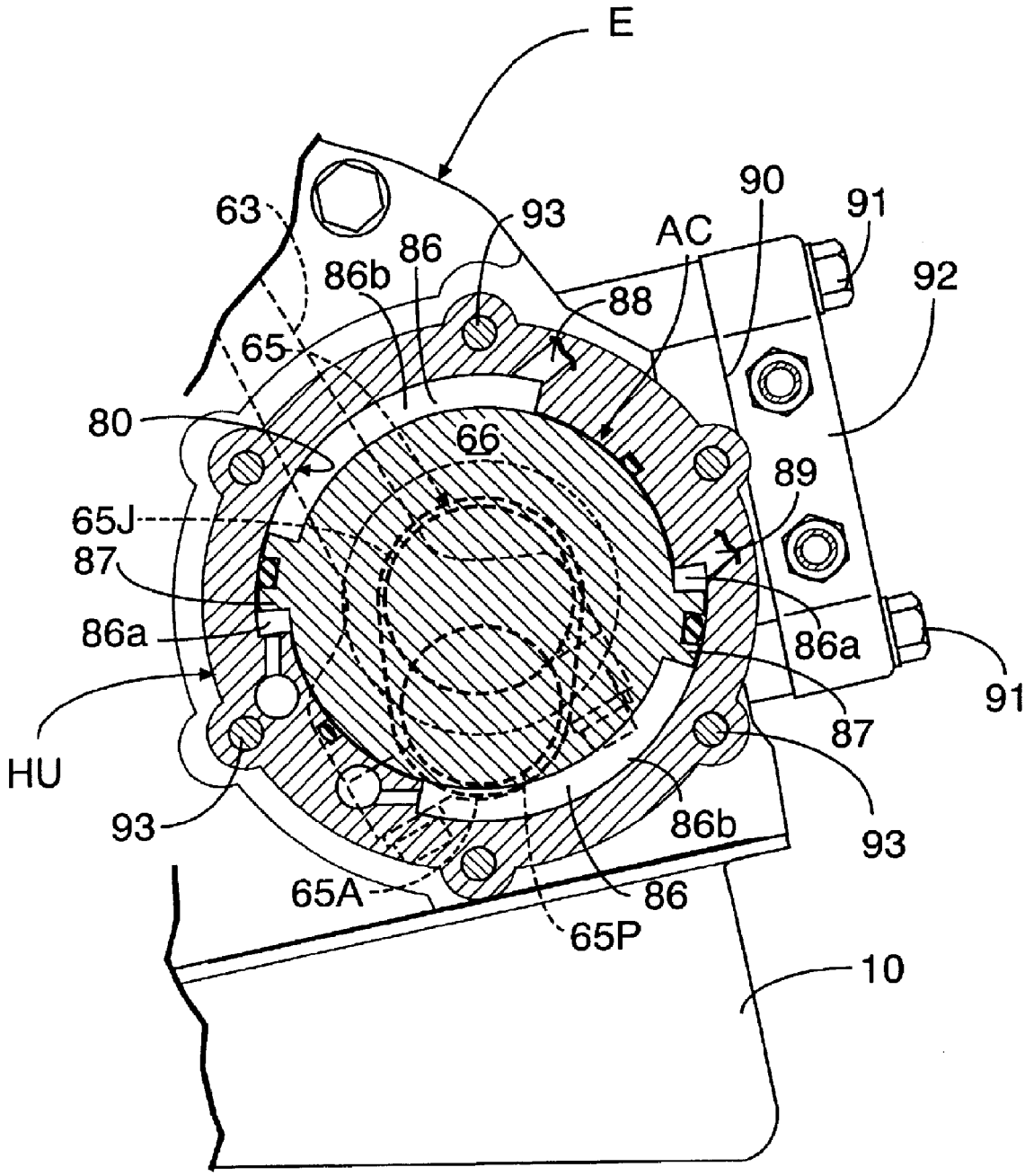
FIG. 14 is a vertical sectional view taken along line XIV-XIV in FIG. 13.
Figure 15:
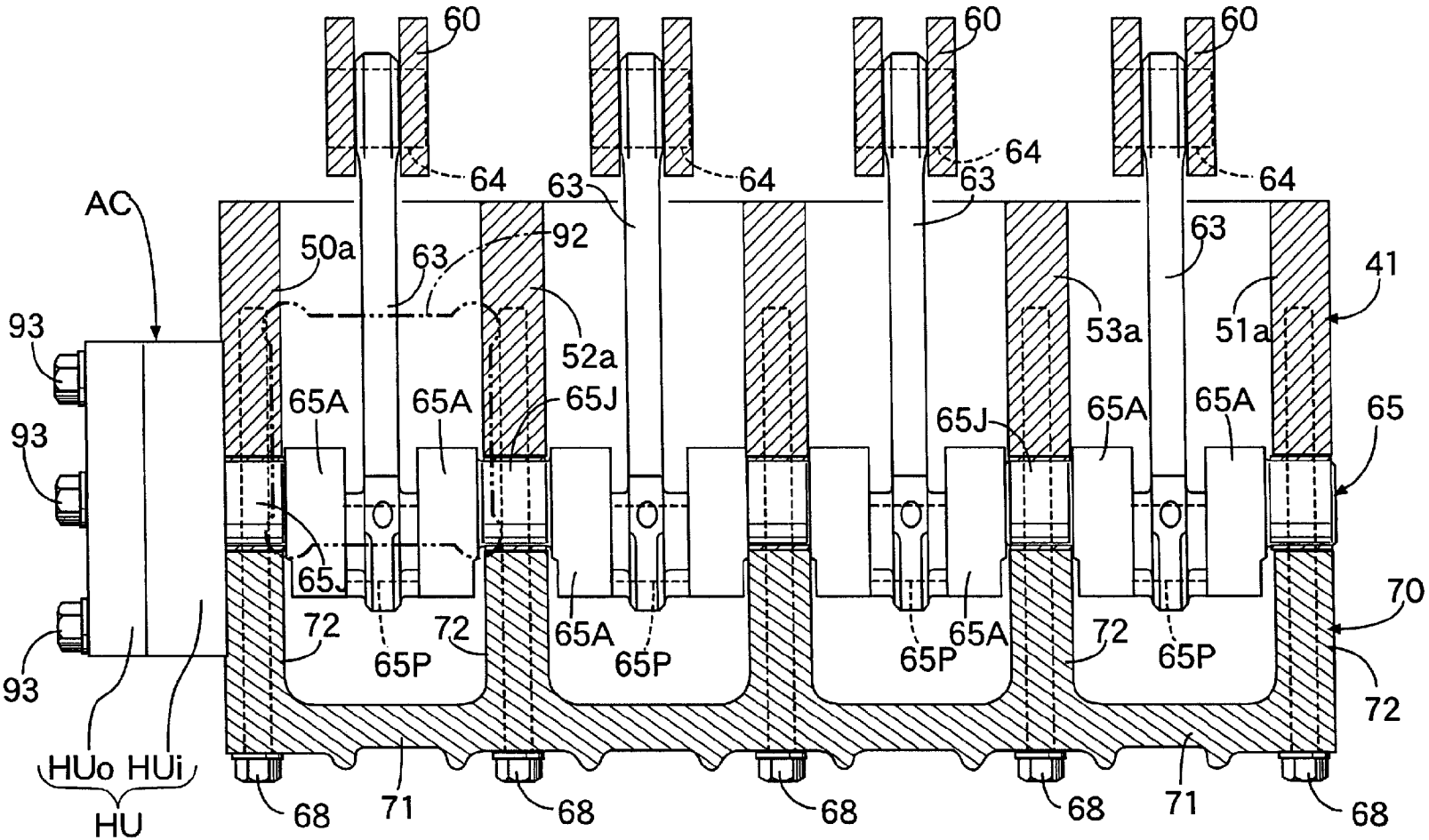
FIG. 15 is a sectional view taken along line XV-XV in FIG. 13.
Figure 16:
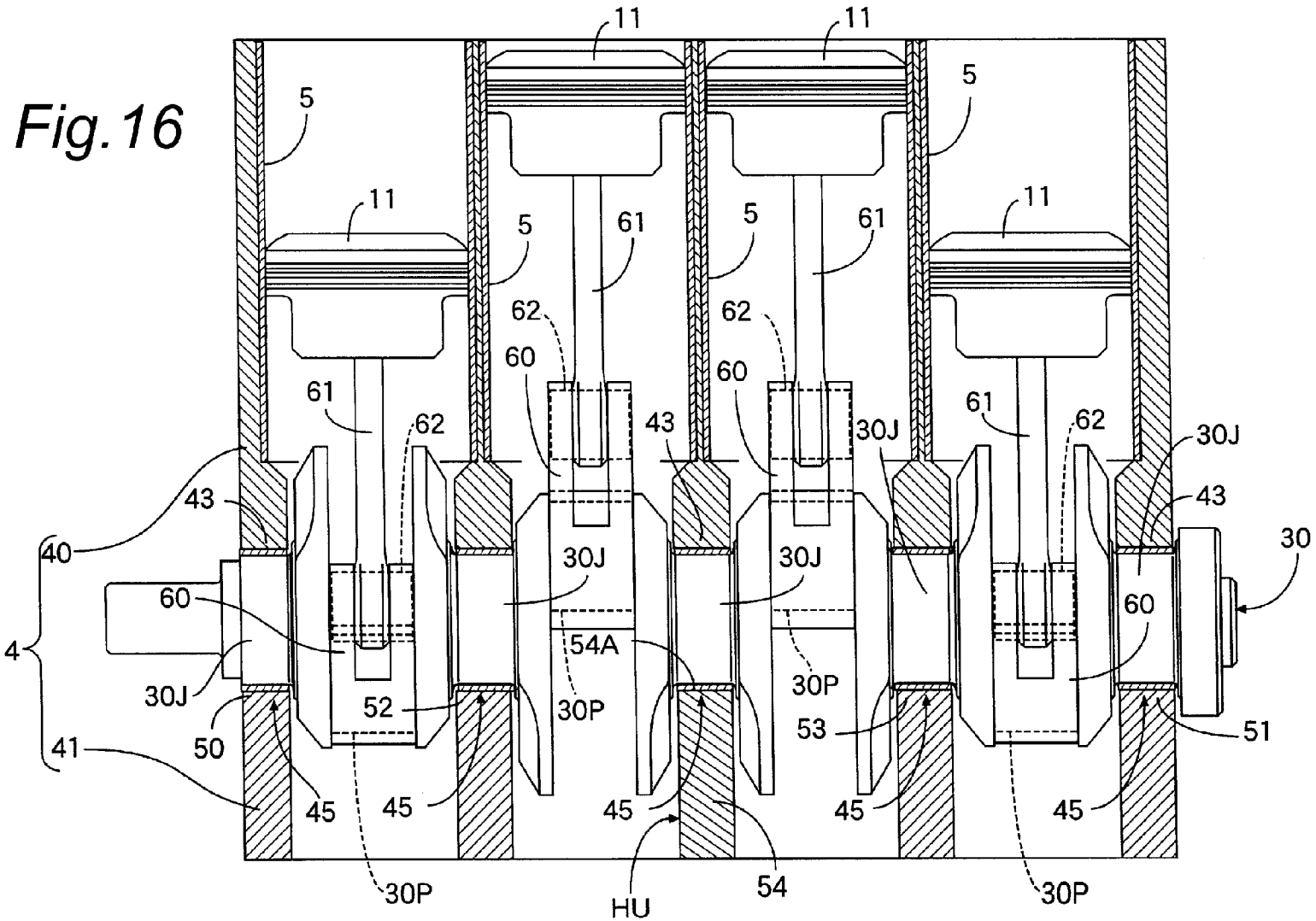
FIG. 16 is a sectional view taken along line XVI-XVI in FIG. 11.
Figure 17:
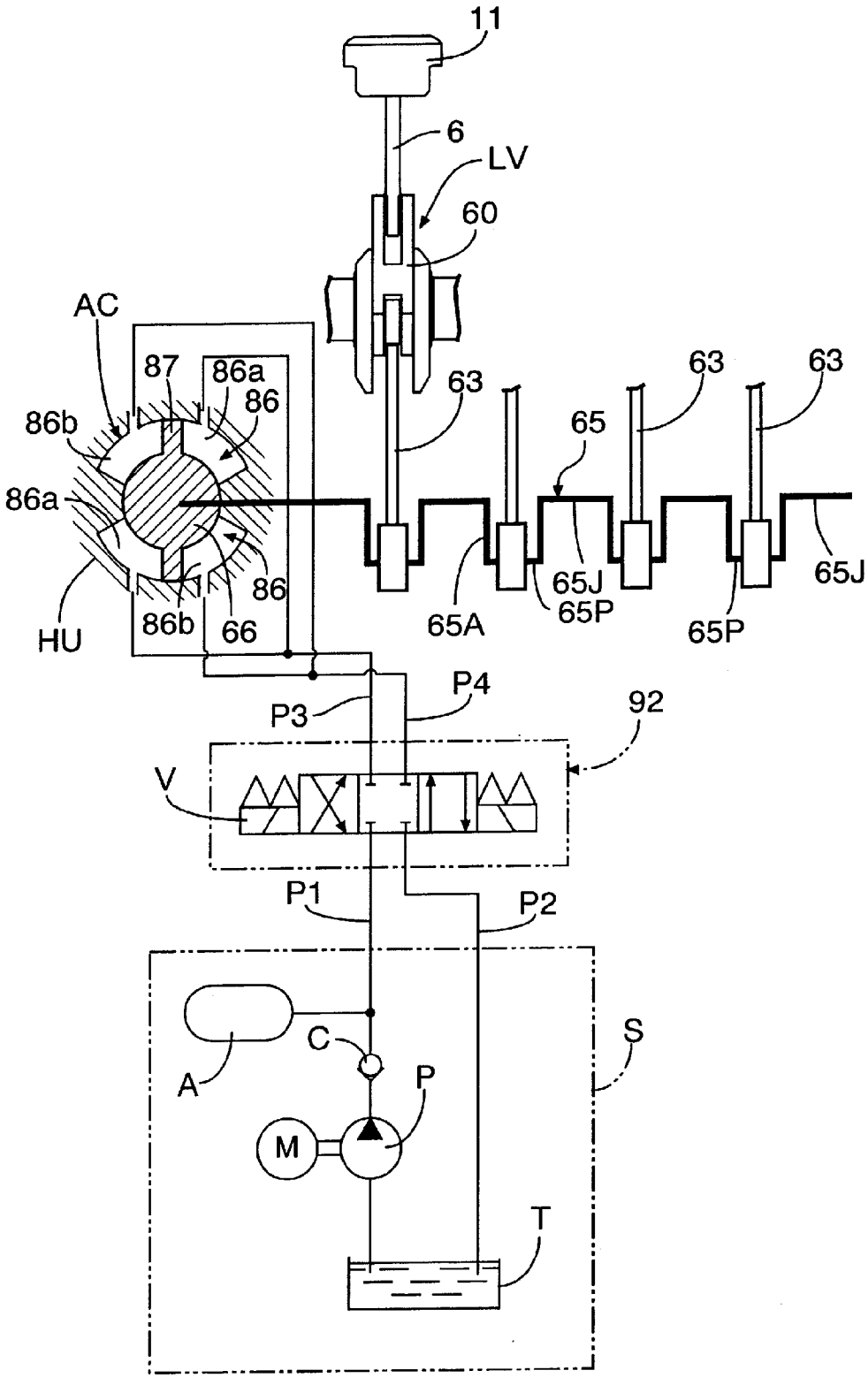
FIG. 17 is a hydraulic circuit diagram of the control system for the hydraulic actuator.
Figure 18:
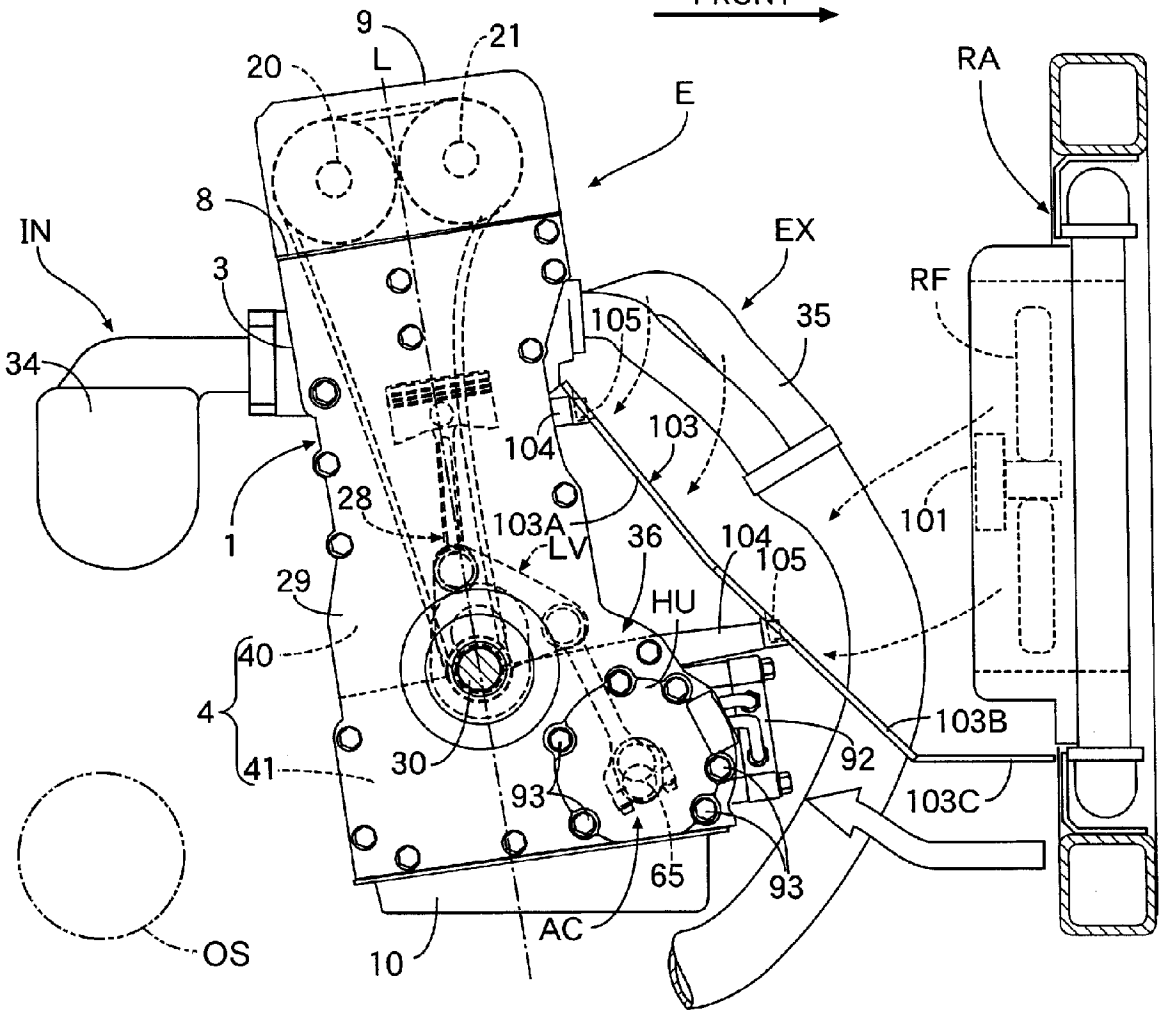
FIG. 18 is a view similar to FIG. 9 showing the seventh embodiment of the present invention.
Figure 19:
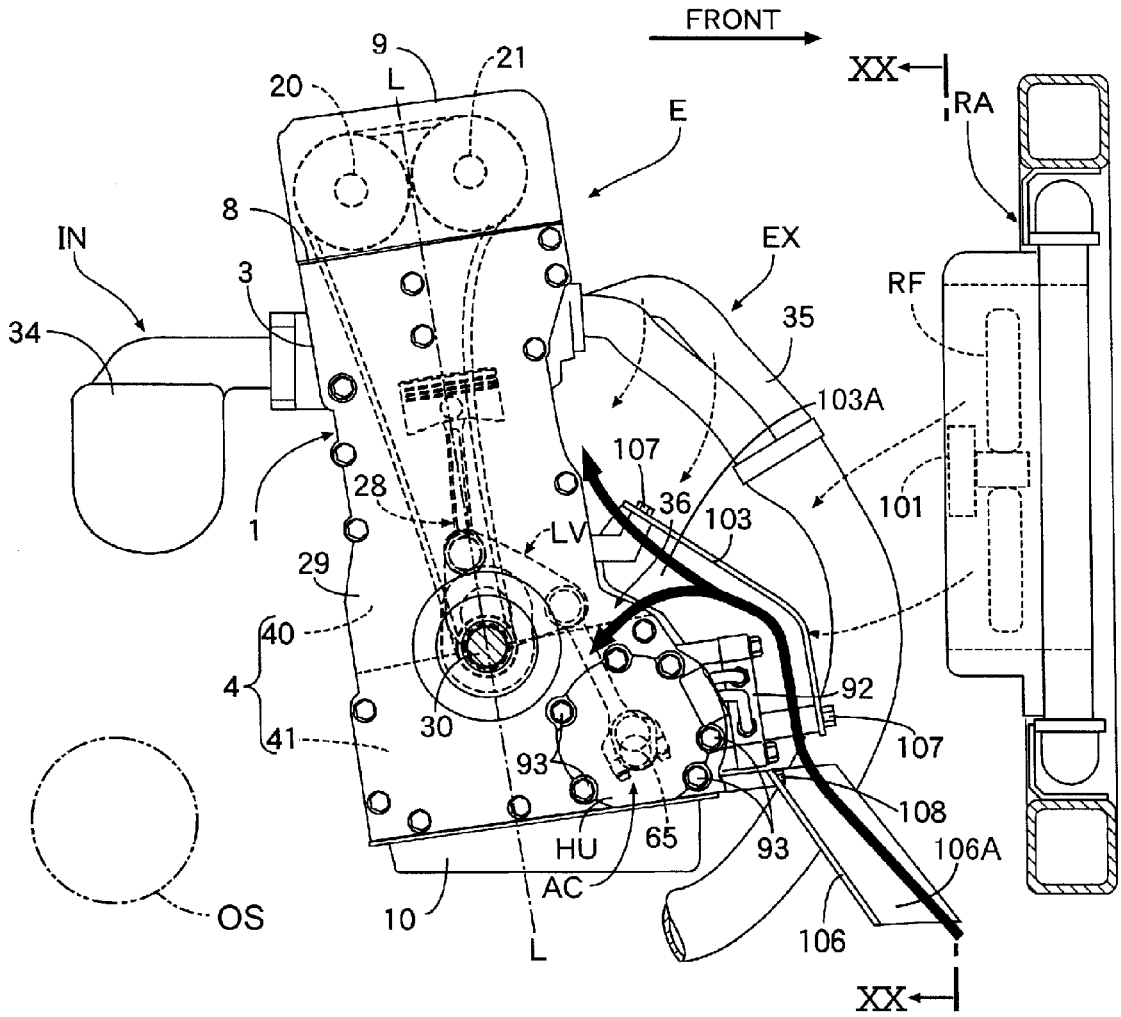
FIG. 19 is a view similar to FIG. 9 showing the eighth embodiment of the present invention.
Figure 20:
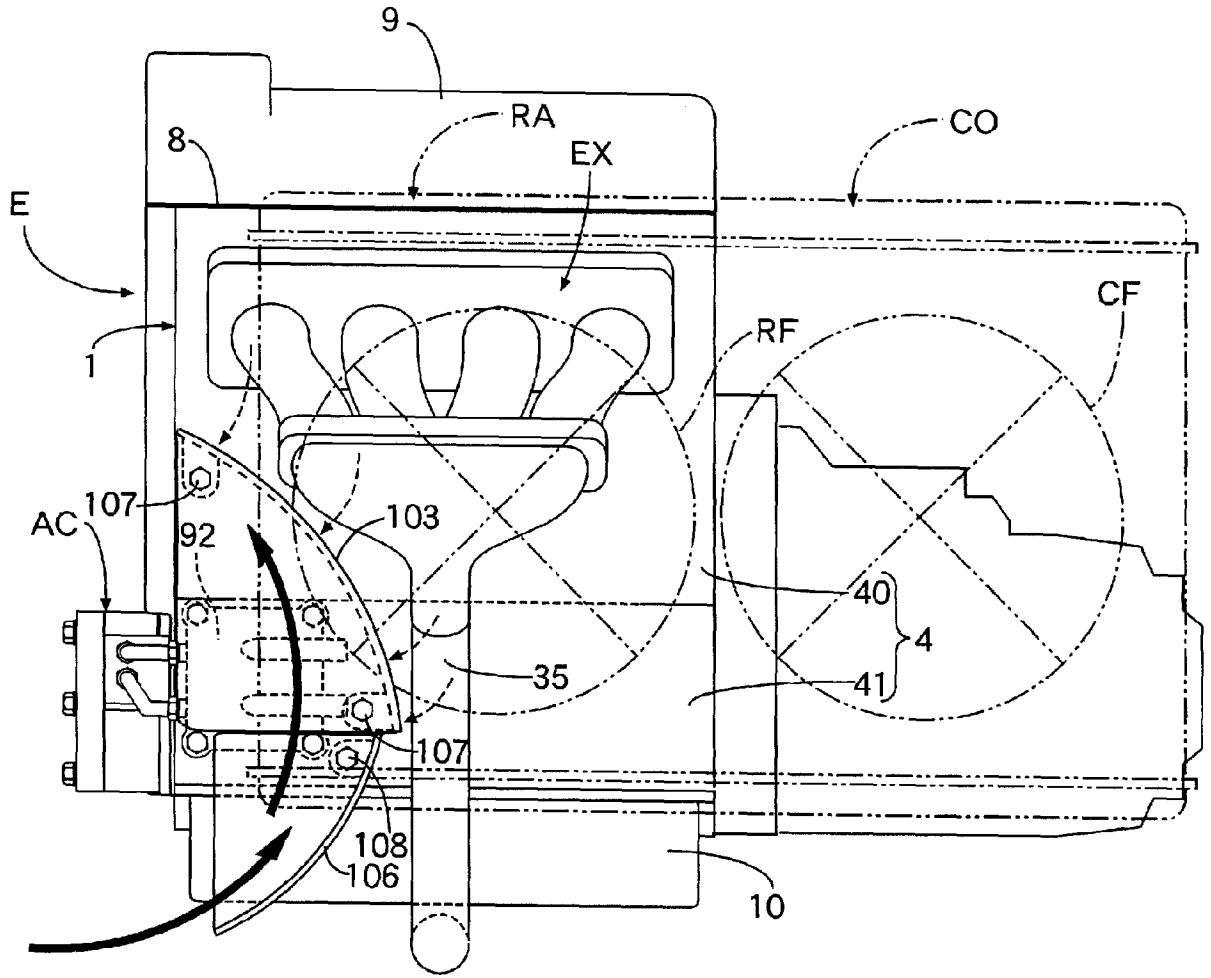
FIG. 20 is a view as seen from the direction indicated by line XX-XX in FIG. 19.
Figure 21:
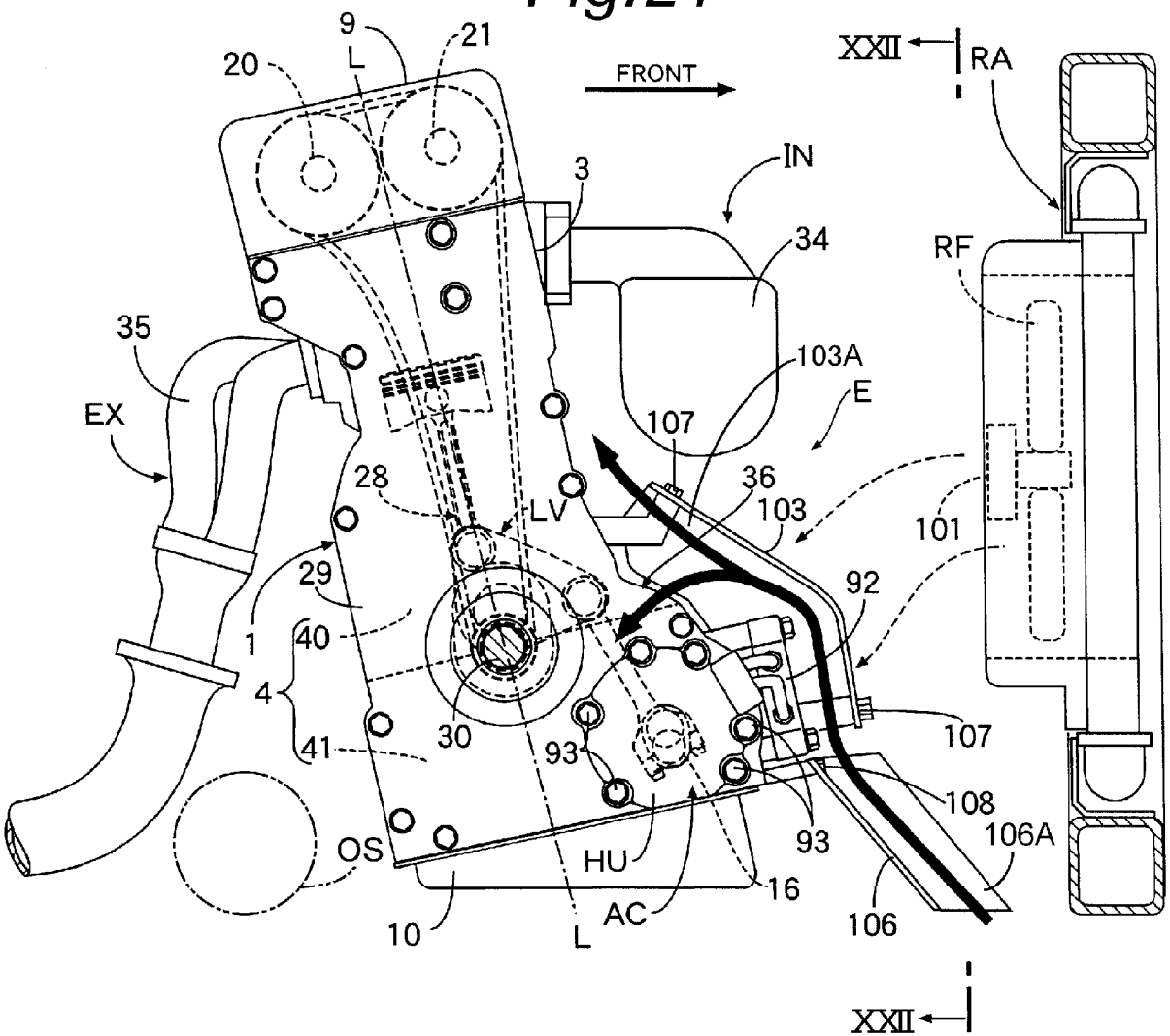
FIG. 21 is a view similar to FIG. 9 showing the ninth embodiment of the present invention.
Figure 22:
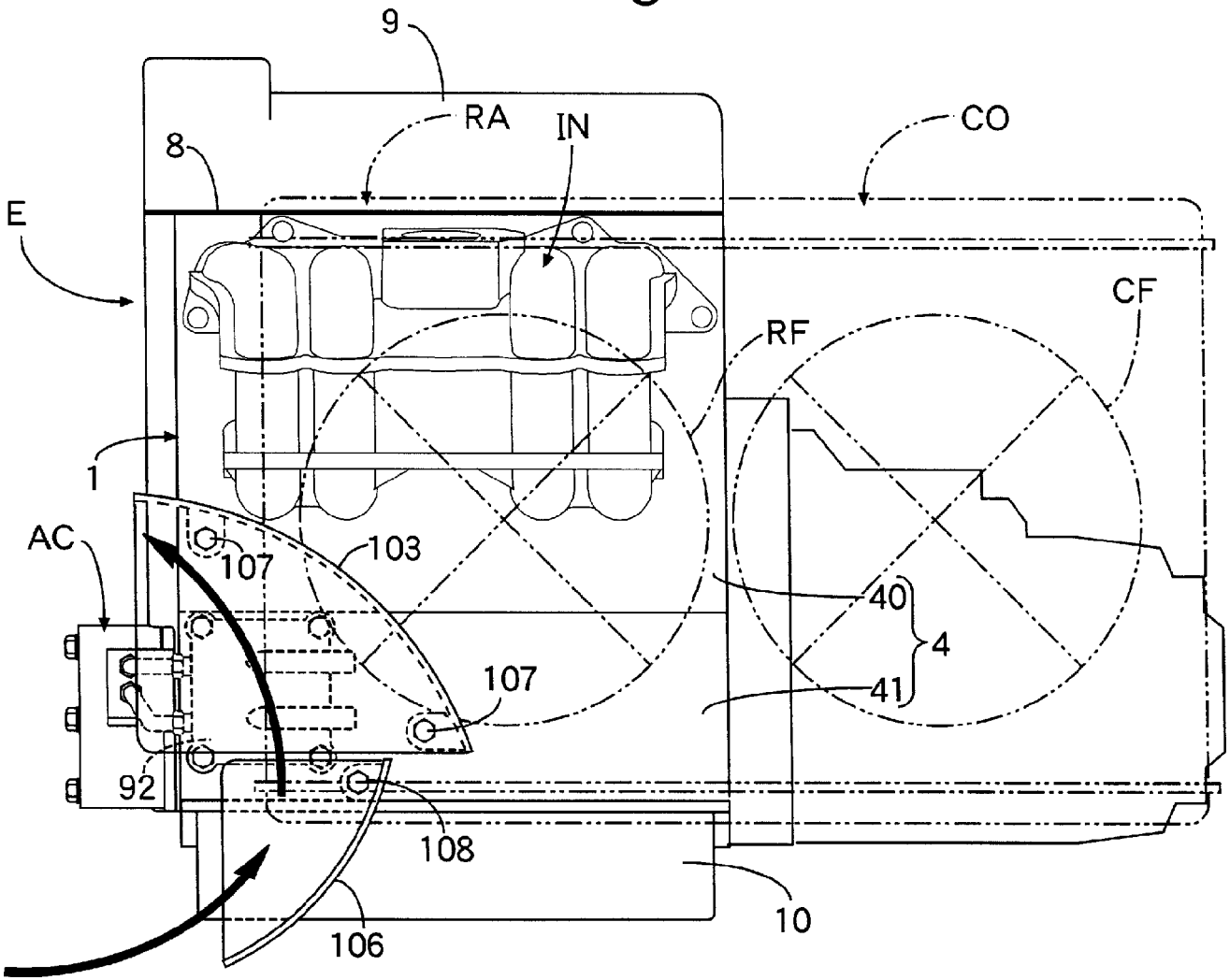
FIG. 22 is a view as seen from the direction indicated by line XXII-XXII in FIG. 21.
Figure 23:
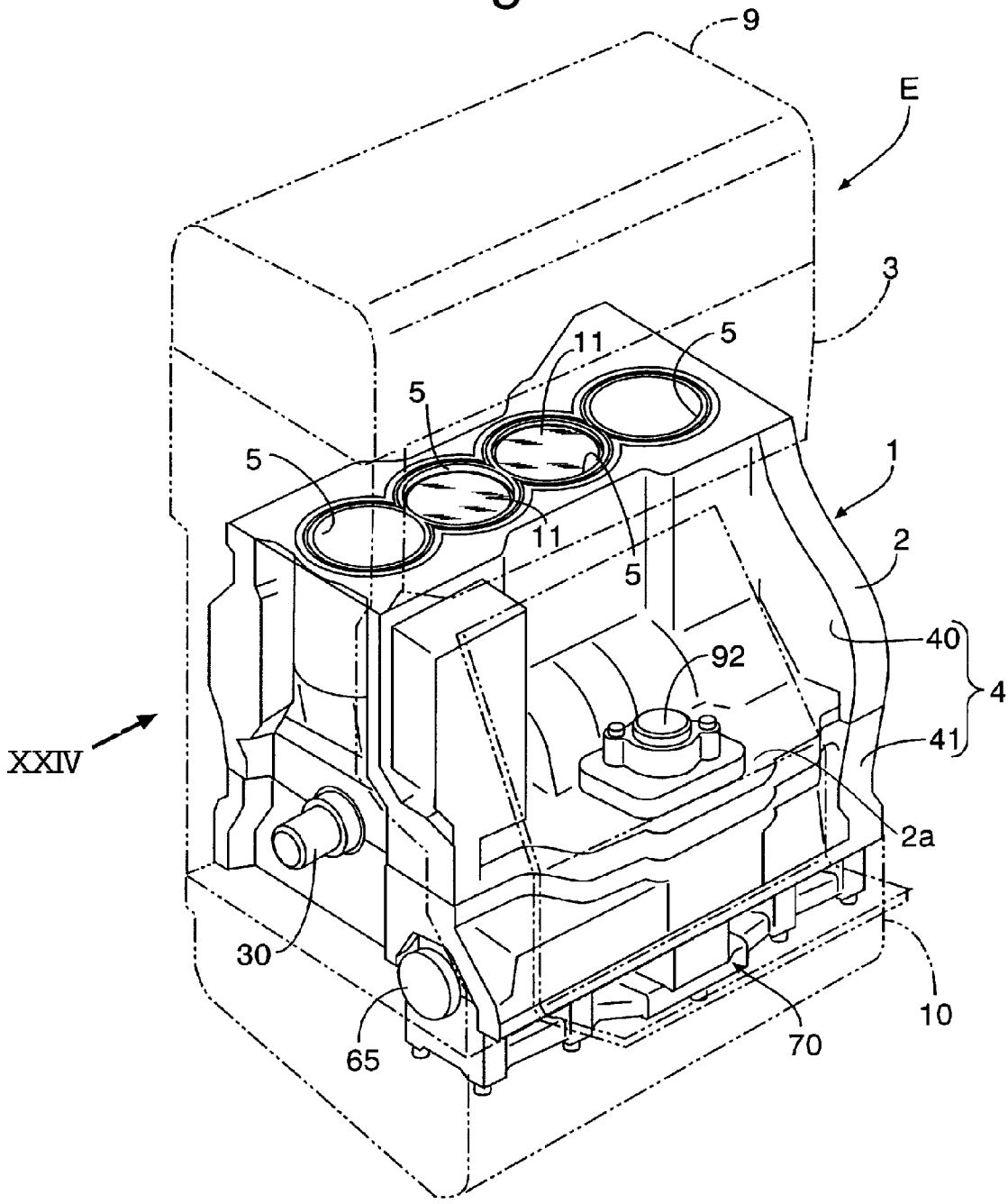
FIG. 23 is a overall perspective view of the variable stroke engine of the tenth embodiment of the present invention.
Figure 24:
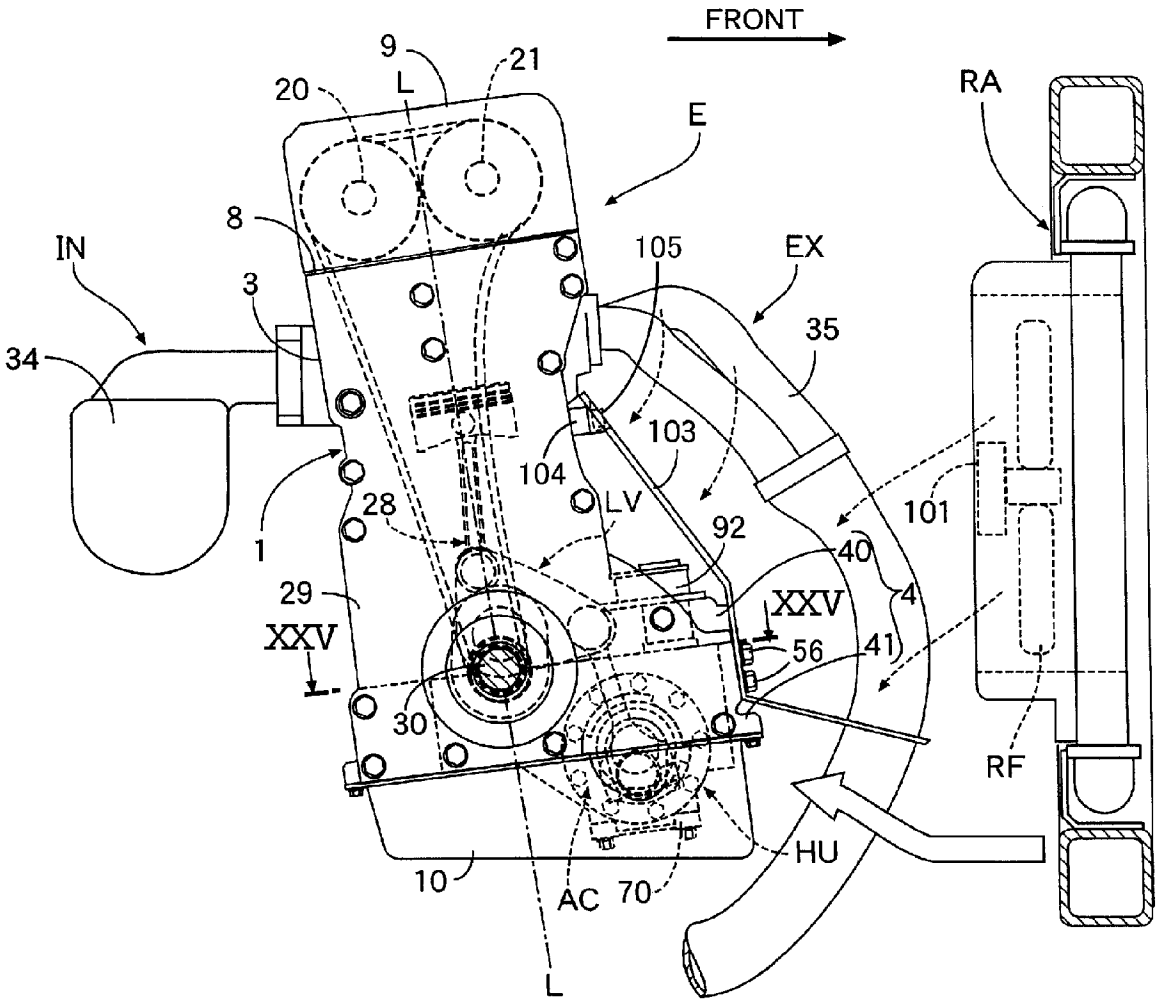
FIG. 24 is a view as seen from the direction indicated by XXIV in FIG. 23.
Figure 25:
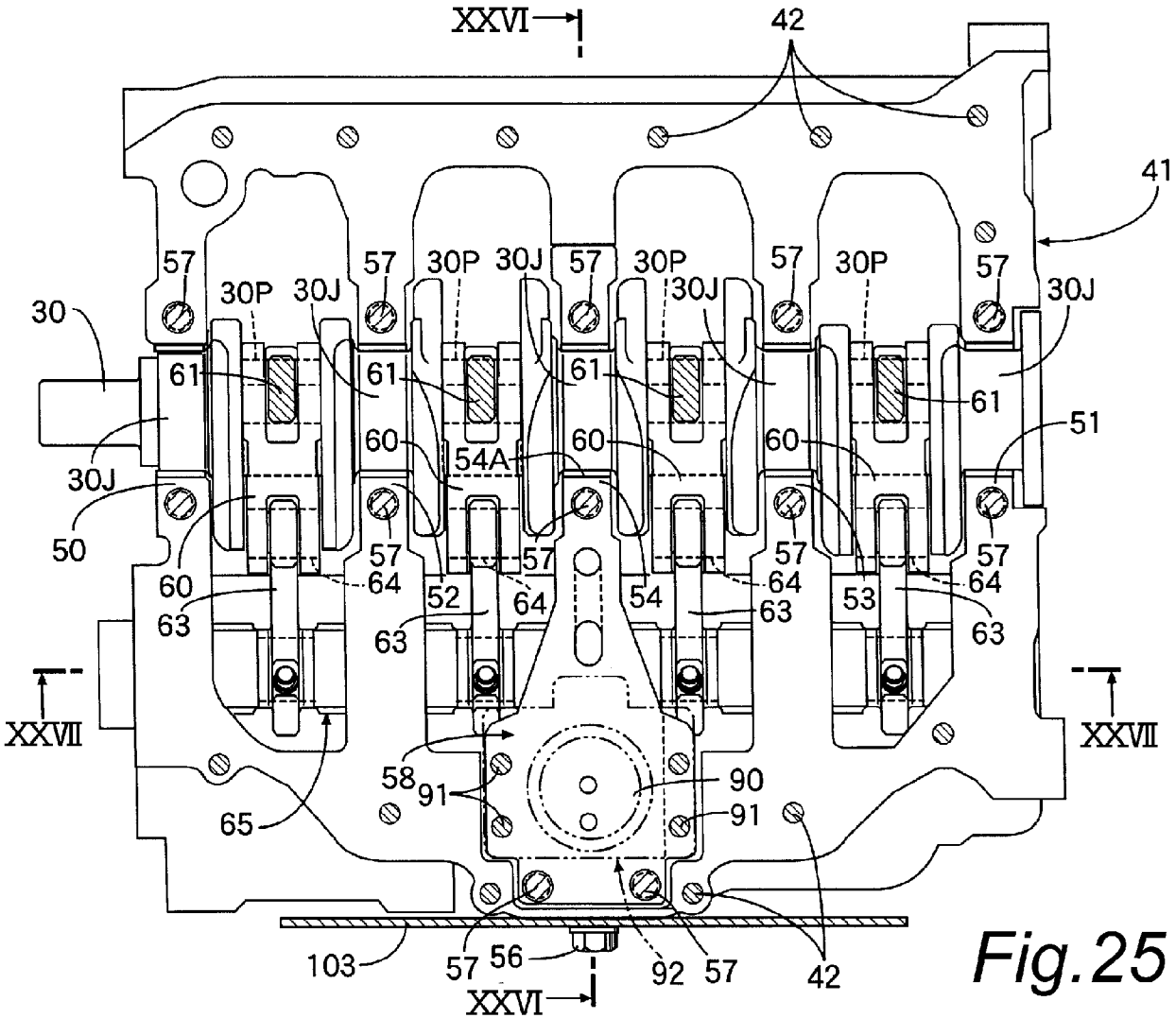
FIG. 25 is a view as seen from the direction indicated by line XXV-XXV in FIG. 24.
Figure 26:
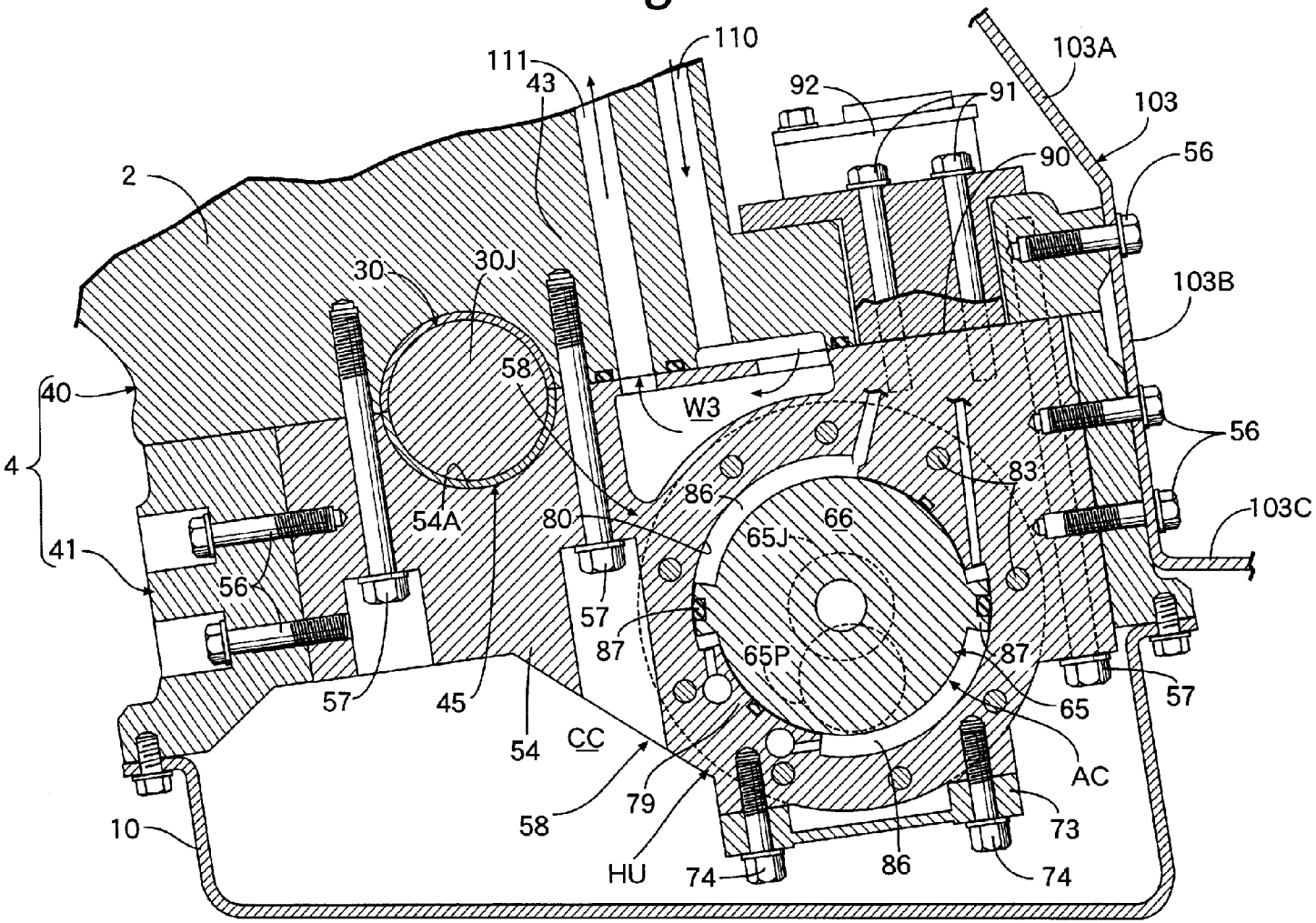
FIG. 26 is a view as seen from the direction indicated by line XXVI-XXVI in FIG. 25.
Figure 27:
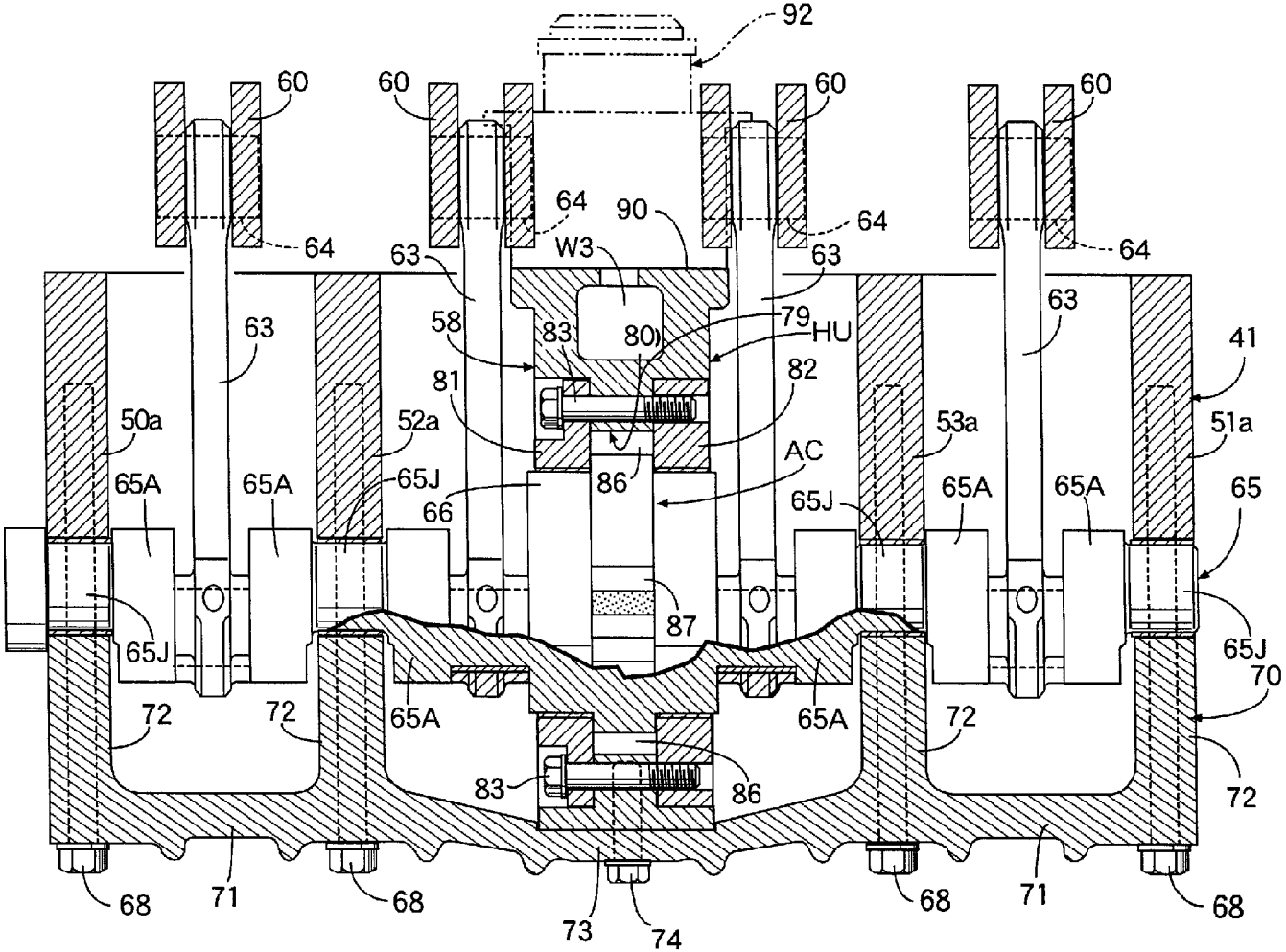
FIG. 27 is a view as seen from the direction indicated by line XXVII-XXVII in FIG. 25.
Figure 28:
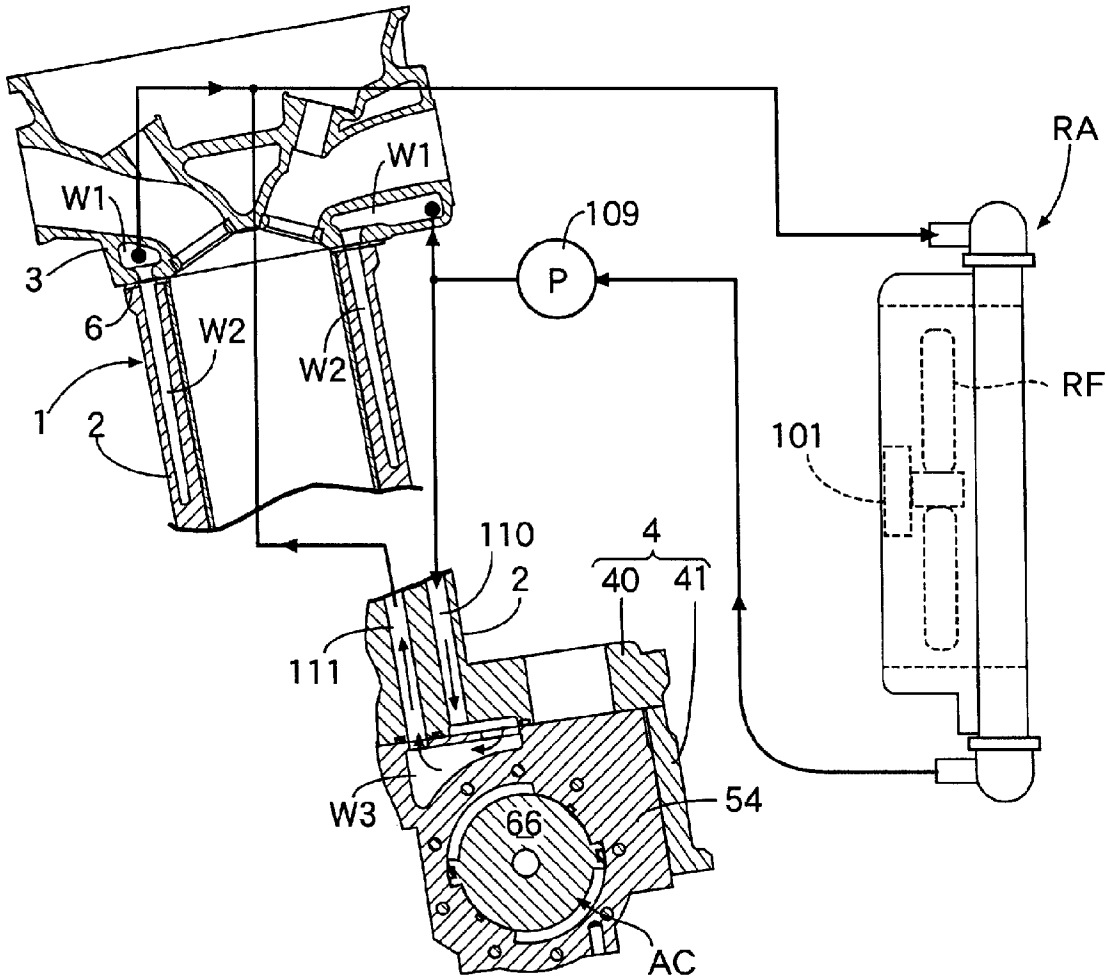
FIG. 28 is a cooling system circuit diagram of the hydraulic actuator.
Figure 29:
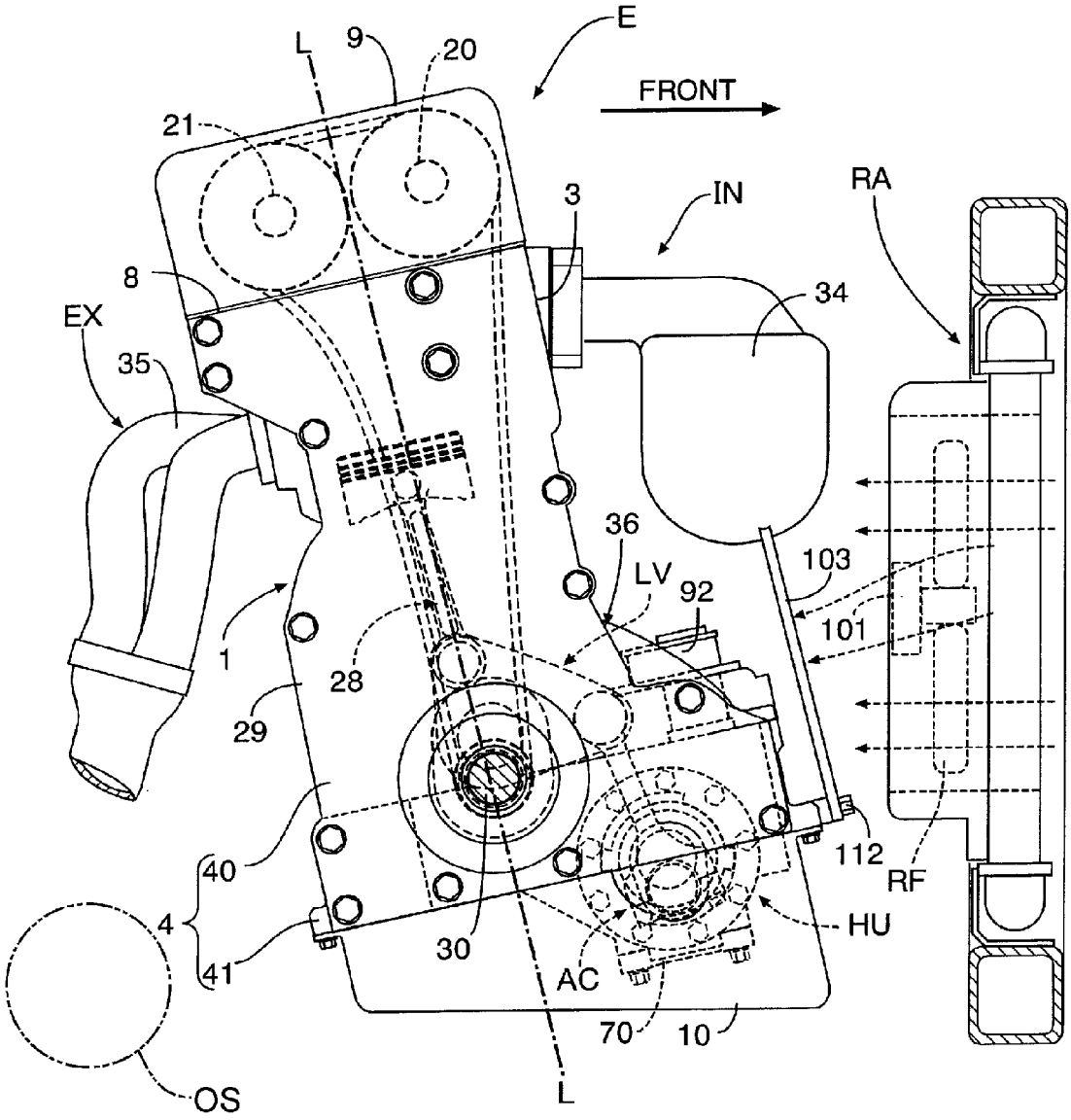
FIG. 29 is a view similar to FIG. 9 showing the eleventh embodiment of the present invention.

The invention claimed is:

1. A variable stroke engine assembly for a front engine, front wheel drive vehicle, comprising:

a piston slidably received in a cylinder;

a crankshaft rotatably support by an engine main body;

an output shaft extending along a rear side of the engine main body substantially in parallel with the crankshaft to transmit an engine output to front wheels of a vehicle carrying the engine assembly;

a connecting mechanism functionally connecting the piston with the crankshaft, the connecting mechanism including a lower link pivotally supported by a crankpin of the crankshaft, an upper link connecting one end of the lower link to a piston pin of the piston, and a control link connected to another end of the lower link and an eccentric portion of the control link so that a piston stroke may be varied by turning the control shaft;

a control shaft rotatably supported by the engine main body and coupled to the connecting mechanism for varying a configuration of the connecting mechanism; and an actuator coupled to the control shaft for driving the control shaft; and a starter motor mounted on the engine main body on an opposite side of a connecting point between the lower link and the control link with respect to a reference line passing through an axial center of the crankshaft and extending in parallel with a cylinder axial line, wherein the engine main body is tilted rearward and the control shaft and the actuator are disposed on a different side of the crankshaft than the output shaft as seen in plan view, the actuator being located in front of the engine at a substantially same elevation as the output shaft.

2. The variable stroke engine assembly according to claim 1, wherein the control shaft is disposed substantially in parallel with the crankshaft.

3. The variable stroke engine according to claim 1, wherein both the actuator and control shaft are disposed on the different side of the output shaft with respect to the crankshaft, and the actuator provides a greater road clearance than an engine component that defines a minimum road clearance.

4. The variable stroke engine assembly according to claim 1, wherein a starter motor is mounted on the engine main body on an opposite side of an axial center of the control shaft with respect to a reference line passing through an axial center of the crankshaft and extending in parallel with a cylinder axial line.

5. The variable stroke engine assembly according to claim 1, wherein the control shaft is located at a higher elevation than a connecting point between the lower link and the control link; and a starter motor is mounted on a part of the engine main body at a lower elevation than the connecting point between the lower link and the control link.

6. The variable stroke engine assembly according to claim 1, wherein the engine consists of an in-line multiple cylinder engine;

a transmission system is connected to an axial end of the engine main body;

a connecting point between the lower link and the control link for a cylinder adjacent to the transmission system is located at a lower elevation than a connecting point between the lower link and the control link for another cylinder;

the control shaft is located at a higher elevation than the connecting point between the lower link and the control link; and a starter motor is mounted on the axial end of the engine main body adjacent to the transmission system at a higher elevation than the connecting point between the lower link and the control link for the cylinder adjacent to the transmission system.

7. The variable stroke engine assembly according to claim 1, wherein the control shaft is located at a lower elevation than a connecting point between the lower link and the control link; and a starter motor is mounted on the engine main body at a higher elevation than the connecting point between the lower link and the control link.

8. The variable stroke engine assembly according to claim 1, wherein the control shaft is located at a lower elevation than a connecting point between the lower link and the control link;

a starter motor is mounted on the engine main body at a higher elevation than the connecting point between the lower link and the control link; and the distance from the connecting point between the lower link and control link to an axial center of the crankshaft is always smaller than the distance from an axial center of the control shaft to an axial center of the crankshaft.

9. A variable stroke engine assembly for a front engine, front wheel drive vehicle, comprising: a piston slidably received in a cylinder; a crankshaft rotatably support by an engine main body; an output shaft extending along a rear side of the engine main body substantially in parallel with the crankshaft to transmit an engine output to front wheels of a vehicle carrying the engine assembly; a connecting mechanism functionally connecting the piston with the crankshaft, the connecting mechanism including a lower link pivotally supported by a crankpin of the crankshaft, an upper link connecting one end of the lower link to a piston pin of the piston, and a control link connected to another end of the lower link and an eccentric portion of the control link so that a piston stroke may be varied by turning the control shaft; a control shaft rotatably supported by the engine main body and coupled to the connecting mechanism for varying a configuration of the connecting mechanism, the control shaft located at a lower elevation than a connecting point between the lower link and the control link; a starter motor mounted on the engine main body at a higher elevation than the connecting point between the lower link and the control link with respect to a reference line passing through an axial center of the crankshaft and extending in parallel with a cylinder axial line, the distance from the connecting point between the lower link and control link to an axial center of the crankshaft always being smaller than the distance from an axial center of the control shaft to an axial center of the crankshaft; and an actuator coupled to the control shaft for driving the control shaft; wherein the engine main body is tilted rearward and the control shaft and the actuator are disposed on a different side of the crankshaft than the output shaft as seen in plain view, the actuator being located in front of the engine at a substantially same elevation as the output shaft.

10. The variable stroke engine assembly according to claim 9, wherein the control shaft is disposed substantially in parallel with the crankshaft.

11. The variable stroke engine according to claim 9, wherein both the actuator and control shaft are disposed on the different side of the output shaft with respect to the crankshaft, and the actuator provides a greater road clearance that an engine component that defines a minimum road clearance.

12. The variable stroke engine according to claim 9, wherein a starter motor is mounted on the engine main body on an opposite side of a connecting point between the lower link and the control link with respect to a reference line passing through an axial center of the crankshaft and extending in parallel with a cylinder axial line.

13. The variable stroke engine assembly according to claim 9, wherein the engine consists of an in-line multiple cylinder engine; a transmission system is connected to an axial end of the engine main body; a connecting point between the lower link and the control link for a cylinder adjacent to the transmission system is located at a lower elevation than a connecting point between the lower link and the control link for another cylinder; the control shaft is located at a higher elevation than the connecting point between the lower link and the control link; and a starter motor is mounted on the axial end of the engine main body adjacent to the transmission system at a higher elevation than the connecting point between the lower link and the control link for the cylinder adjacent to the transmission system.

14. The variable stroke engine assembly according to claim 9, wherein the control shaft is located at a lower elevation than a connecting point between the lower link and the control link; and a starter motor is mounted on the engine main body at a higher elevation than the connecting point between the lower link and the control link.

* * * * *